US008628099B2

(12) United States Patent
Gregory et al.

(10) Patent No.: US 8,628,099 B2
(45) Date of Patent: Jan. 14, 2014

(54) REMOVABLE WHEEL MOUNTING ASSEMBLY

(75) Inventors: Brett J. Gregory, Valencia, CA (US); Michael W. Keever, Chino, CA (US); Ted J Hauser, Simi Valley, CA (US)

(73) Assignee: Portaboard, LLC, Valencia, CA (US)

( * ) Notice: Subject to any disclaimer, the term of this patent is extended or adjusted under 35 U.S.C. 154(b) by 978 days.

(21) Appl. No.: 11/542,103

(22) Filed: Oct. 2, 2006

(65) Prior Publication Data

US 2007/0035100 A1 Feb. 15, 2007

Related U.S. Application Data

(63) Continuation-in-part of application No. 11/197,578, filed on Aug. 3, 2005, now Pat. No. 7,635,137, and a continuation-in-part of application No. 11/473,948, filed on Jun. 23, 2006, now abandoned.

(51) Int. Cl.
*B62M 1/00* (2010.01)

(52) U.S. Cl.
USPC ..... 280/87.042; 280/87.05; 280/87.041

(58) Field of Classification Search
USPC ..... 280/63, 11.27, 11.28, 11.3, 767, 87.01, 280/87.021, 87.041, 87.042, 87.05
See application file for complete search history.

(56) References Cited

U.S. PATENT DOCUMENTS

| | | | | |
|---|---|---|---|---|
| 4,458,907 | A | 7/1984 | Meredith | |
| 4,721,325 | A * | 1/1988 | Mackovjak et al. | 280/124.155 |
| 4,955,626 | A * | 9/1990 | Smith et al. | 280/87.042 |
| 5,340,132 | A * | 8/1994 | Malewicz | 280/11.221 |
| 5,505,474 | A | 4/1996 | Yeh | |
| 5,520,405 | A * | 5/1996 | Bourke | 280/613 |
| 5,540,455 | A | 7/1996 | Chambers | |
| 5,769,438 | A | 6/1998 | Svetlov | |
| 5,906,388 | A * | 5/1999 | Neiley | 280/613 |
| 6,131,931 | A | 10/2000 | Globerson | |
| 6,135,486 | A * | 10/2000 | Neiley | 280/613 |
| 6,382,638 | B1 * | 5/2002 | Lee | 280/7.13 |
| D473,905 | S | 4/2003 | Schnuckle | |
| 6,631,913 | B2 | 10/2003 | Godfrey | |
| D505,470 | S | 5/2005 | Hong | |
| 7,070,193 | B2 * | 7/2006 | Yamaguchi | 280/87.042 |
| 7,175,187 | B2 * | 2/2007 | Lyden | 280/11.3 |
| 7,243,925 | B2 * | 7/2007 | Lukoszek | 280/11.28 |
| 7,464,944 | B2 * | 12/2008 | Lyden | 280/11.27 |
| 7,810,825 | B2 * | 10/2010 | Cole | 280/87.042 |
| 2003/0127816 | A1 | 7/2003 | Schnuckle et al. | |
| 2003/0201614 | A1 * | 10/2003 | Chi | 280/11.3 |

OTHER PUBLICATIONS

Stowboards Internet pages from Stowboards.com, printed Jun. 23, 2006, 9 pages, Stowboards.com, US.

* cited by examiner

*Primary Examiner* — J. Allen Shriver, II
*Assistant Examiner* — Travis Coolman
(74) *Attorney, Agent, or Firm* — Richard A. Ryan

(57) ABSTRACT

A wheel mounting assembly for removably attaching a wheel assembly, typically comprising an axle and one or more wheels, to a platform attached to or integral with a wheeled object, such as skateboards, roller skates, rollerblades, backpacks, luggage, dollies and the like. The wheel mounting assembly comprises a wheel mount connector attached to the platform and a wheel mount, which is attached to the wheel assembly, that are configured for twist-and-lock engagement. The wheel mount has a mounting cavity for receiving the wheel mount connector and an internal elongated spring member that biases an engagement member into a slot on the wheel mount connector to prevent unintended disengagement of the wheel mounting assembly from the platform. One or more securing mechanisms secure the wheel mount to the wheel mount connector. The wheel mounting assembly can securely join multiple platform sections together without tools to simplify carrying or storing the object.

35 Claims, 20 Drawing Sheets

REMOVABLE WHEEL MOUNTING ASSEMBLY

CROSS-REFERENCE TO RELATED APPLICATIONS

This patent application is a continuation-in-part of U.S. patent application Ser. No. 11/197,578 filed Aug. 3, 2005 now U.S. Pat. No. 7,635,137 and U.S. patent application Ser. No. 11/473,948 filed Jun. 23, 2006 now abandoned.

BACKGROUND OF THE INVENTION

A. Field of the Invention

The field of the present invention relates generally to wheeled objects, such as skateboards, skates, dollies, backpacks, furniture and the like, that have at least one wheel mounting assembly, each with one or more wheels, attached to a platform or like mounting surface which is incorporated therein or connected thereto. More particularly, the present invention relates to such wheel mounting assemblies that are removably attached to the platform or other mounting surface for quick and easy disassembly. Even more particularly, the present invention relates to such wheel mounting assemblies that utilize a twist-and-lock arrangement to removably attach to a mounting surface of the wheeled object.

B. Background

Many objects have one or more wheels attached thereto to assist a person in moving the wheeled object, an object supported by the wheeled object or a person attached to or standing on the wheeled object from one location to another. As an example, some larger sized pieces of furniture have wheels attached to the bottom surface of the furniture to facilitate a person moving the furniture without having to utilize a dolly or the like. Backpacks, luggage and like objects are often provided with one or more wheels to reduce the effort needed to move the object around, particularly when full of items such as books, clothes and the like. As another example, many people use dollies, lifts, carts or similarly configured devices to move objects, particularly objects not having wheels, around to place the object where desired, such as platform or furniture dollies. Some of the dollies, lifts, carts or etc. are specially configured to hold the object to be moved, such as folded chair totes, chair dollies, desk lifts and table/panel movers. As a further example of the use of wheeled objects, many such objects are configured for a person to stand on and move himself or herself around, such as skateboards, roller skates, rollerblades and the like.

A common configuration of the various wheeled objects is that the wheel or wheels are part of a wheel assembly which includes a mounting base that attaches to a platform or other mounting surface which is incorporated into, attached to or otherwise associated with the object. Many of these wheel assemblies are either fixedly attached to the object, by welding, rivets or other substantially non-removable mechanism, or semi-fixedly attached to the object with screws, bolts or other connectors that, while generally removable, are not selected for their removable nature. In many circumstances, this configuration works quite well. In many other circumstances, however, the attachment of the wheel assembly to the object presents problems or limits the uses of the object. For instance, with regard to dollies and the like, the fixedly or semi-fixedly attached wheel assemblies can present problems with regard to stacking of the objects during storage and/or transport. With regard to backpacks and luggage, there are times when the user may prefer the wheels not extend from the bottom thereof, such as when placing the backpack against the wall (i.e., when at school, etc.) or when storing the luggage in a closet or on an airplane. In addition, if the need to replace the wheels or wheel assembly arises, such as due to damage or the desire to upgrade the wheels or use different types of wheels for different conditions, the user usually can only do so with significant difficulty. Some wheeled objects, most notably backpacks, luggage and some furniture, are provided with wheel assemblies that can be retracted into the object or removed from the object altogether. As far as the wheel assembly being removable, which is most commonly found on some desks, couches, chairs and the like, these are generally the type of wheel assembly that has an upwardly extending portion that is engagedly received in a cavity on the object. Other than these, which have somewhat limited applicability for most wheeled objects, there are very few wheel systems available that are configured to be securely attached when desired for operation yet relatively easily removed from the wheeled object when necessary or desirable to replace.

A removable wheeled system would be particularly beneficial for use with skateboards, roller skates, rollerblades and the like. These wheeled objects are very commonly utilized by people to move themself from one place to another, whether for a specific destination, such as going to school, or just for entertainment. The standard skateboard, as an example, has an elongated platform having a top surface on which the rider stands and a bottom surface that connects to one or more wheel assemblies that roll across the ground. The platform is sized to allow the rider to be able to place all or a portion of both of his or her feet on the upper surface when riding the skateboard. Although in the past the platform was almost always configured to be substantially planar and made out of wood, modern skateboards are known to have a variety of shapes, including generally uplifting ends, and be made out of a variety of different types of materials, including various metal, thermoplastic and composite materials. The typical wheel assembly comprises a pair of truck mechanisms that each have a plurality of wheels, typically two for each truck, which are rotatably connected to an axle. Standard skateboards typically have the truck mechanisms attached to the underside of the board with mechanical connectors, such as rivets, screws or bolts, or specially configured adhesives. Roller skates and rollerblades typically have a shoe or shoe-like member that the person wears or which attaches to his or her shoes with the wheel assembly, comprising one or more wheels, attached to the bottom thereof for moving across the ground or other surface.

Although skateboarding, roller skating and rollerblading are popular among people of all ages, they tend to be most popular among younger persons who like to ride the objects as a means of transportation to get to school, stores, after school sports practices, movies and other activities in addition to use for general recreation. A significant problem for use of these objects as a means of transportation, for riders of all ages, is what to do with the object once the rider gets to where he or she is going. Although most people can carry the objects, they are not necessarily small or lightweight and most people do not want to carry them around with them while they walk to and from classes or around the store or other activity. Storage of the skateboard, roller skates or rollerblades in a locker or other container is generally not practical and they are generally not configured for attachment to bicycle racks or other storage areas. To compound the problem, many of the destinations where a rider is likely to go, such as schools and stores, do not allow riding of these objects on the premises. This is a particular problem with regard to schools, which is perhaps the most convenient and logical destination for younger riders, which often have strict rules prohibiting riding or even carrying skateboards, roller skates and rollerblades on the campus due to safety and discipline concerns. Likewise, many stores, malls and the like also do not want patrons to be walking around carrying these objects. Because there is typically no real satisfactory outside storage solution that provides convenient and safe storage of the rider's skateboard, roller skates or roller blades, the utility of these objects as a means of transportation to get to school, stores and other destinations is generally substantially limited.

Due to the aforementioned carrying and storage problems, there is a need to provide skateboards, roller skates and rollerblades that are easier to carry and store and which are configured to allow the user to more easily replace the wheel assemblies as needed or desired. A number of patents are directed to skateboards that are configured to be detachable or foldable so as to be more easily carried and stored by the rider when not in use. For instance, U.S. Pat. No. 6,631,913 to Godfrey describes a detachable interchangeable skateboard having an H-shaped locking brace that interconnects two halves of the skateboard, each having a top and bottom platform, configured to allow the user to change the top platform to change the look of the skateboard and/or replace worn components. The wheel assemblies are attached to the lower platform. U.S. Pat. No. 6,131,931 to Globerson, et al. describes a folding skateboard having a three-piece platform with the sections hinged together and configured such that when the skateboard is folded the trucks and wheels of the skateboard, which are attached to the front and back platform sections, are adjacent to each other. Rods, clips or other members hold the skateboard in its folded configuration. U.S. Pat. No. 5,769,438 to Svetlov describes a three-piece folding skateboard that has a locking mechanism that extends or retracts a pair of rods from a pair of receiving elements to secure the skateboard in an extended position or to allow the user to fold the skateboard. U.S. Pat. No. 5,505,474 to Yeh describes a folding skateboard that has a frame made up of frame bars connected by links and a pair of pivoting couplings that connect the wheel assemblies to the frame. A foot plate is supported by each of the wheel assemblies. U.S. Pat. No. D505,470 to Hong illustrates a folding skateboard having a three-piece platform with hinges on top to foldably connect the platform sections. U.S. Pat. No. D473,905 and U.S. Publication No. 2003/0127816, both to Schnuckle, et al., describe foldable skateboards of substantially different configuration than the standard skateboard that has an articulating structure that can be folded for carrying or storage. The skateboard described in the Schnuckle patents appears to be available as the Stowboard™, available from Stowboards.com. U.S. Pat. No. 5,540,455 to Chambers describes an articulating skateboard that articulates and pivots. U.S. Pat. No. 4,458,907 to Meredith describes a skateboard that allows the user to extend or retract the length of the platform. While the foregoing patents generally describe detachable or foldable skateboards that may reduce the overall length of the skateboard, the folded condition of the skateboards appear to be somewhat bulky and, as a result, not necessarily much easier to carry than a conventional skateboard. The bulky nature of these skateboards is because, at least in part, the truck or wheel assemblies are not configured for easy removal. In addition, some of the foregoing appear to have folding or bending apparatuses that provide a skateboard that may not be fully secured when it is placed in the extended, riding position. This would appear to present problems from a riding enjoyment and safety standpoint.

In addition to problems with regard to storage and transport of skateboards, roller skates and rollerblades, many users desire to replace the wheel assembly or assemblies when they are damaged, as they become worn or to change to a different type of wheel assembly or wheel. Because these objects are frequently ridden on surfaces that have pebbles, rocks or debris which can damage the surface of the wheel, which typically does not contact the deck or shoe-like component, the user may want to replace just the wheels. Likewise, as the wheels become worn due to the frequent rolling action on surfaces, a problem not typically suffered by the deck or shoe-like components, the user may want to install new wheels on the same deck or shoe-like components. In addition, as known by those who engage in skateboarding, roller skating or rollerblading activities, certain wheel assemblies or wheel materials work better on different types of surfaces, such as asphalt versus concrete or wood. As a result, the user may want to be able to adjust to the different surface condition by changing his or her wheel assemblies or wheels to components which are better suited for the surface on which he or she will ride. In addition, new development in wheel technology, including materials used for the wheels themselves, may lead to the user wanting to upgrade his or her wheel assemblies to that newer technology.

Other than the removable furniture wheels referenced above, no known wheel assembly provides for easily and quickly removing the wheel assembly from the platform or other surface to which the wheel assembly is attached. As set forth above, such a wheel assembly would be useful for a variety of wheeled objects, including skateboards, roller skates, rollerblades, dollies, lifts, carts, furniture, backpacks, luggage and the like. What is needed, therefore, is a wheel assembly that is configured such that the wheel portion is removable from the object so as to better facilitate carrying and storage of the object when it is not in use and which can be securely attached to the object when it is desired to move the object or move using the object. The preferred removable wheel assembly should be adaptable to a variety of different type of wheeled objects and systems and have components that are easily and quickly assembled and disassembled without the use of any tools. The preferred wheel assembly should be suitable for being manufactured out of lightweight, strong materials to reduce the burden on the user when he or she is carrying the object and/or wheel assembly when not in use.

SUMMARY OF THE INVENTION

The removable wheel assembly of the present invention solves the problems and provides the benefits identified above. That is to say, the present invention discloses an improved wheel mounting assembly that is easily and quickly removed from a wheeled object to make it easier to carry and store the object and which can be easily and quickly attached to the object when needed. The removable wheel mounting assembly of the present invention can be removed and attached without the use of tools and, when assembled, provides a secure, stable platform for safely moving the object or riding the object. In one preferred embodiment, the disassembled components of the wheel mounting assembly can be conveniently stored in a carrying case or storage container, including lockers and the like, when not in use. Preferably, the removable wheel mounting assembly of the present invention is made out of strong, lightweight materials and configured so as to reduce the weight of the components so that they may be easily carried when not in use. The removable wheel mounting assembly of the present invention can be used with a variety of different types and styles of wheeled objects having platforms or other mounting surfaces.

In a preferred embodiment of the present invention, the removable wheel mounting assembly comprises an outwardly projecting wheel mount connector located on a platform or other mounting surface of a wheeled object that is engagedly received in a mounting cavity on a wheel mount, which is attached to the wheel assembly, such that the wheel mounting assembly is mounted to the platform using a twist-and-lock type of engagement. Preferably, the twist-and-lock engagement is achieved by cooperative engagement of projecting and receiving lips on the wheel mount connector and wheel mount, respectively, and with the use of a spring member disposed in the cavity that is attached to the wheel mount so as to bias an engagement member, which is attached to or integral with the spring member, into a slot disposed in the wheel mount connector. When the wheel mounting assemblies are twisted onto the connectors, the engagement member is first biased upward into the mounting cavity and then, when aligned with the slot, biased into the slot. Placement of the engagement member into the slot prevents any further rotation of the mounting assembly so as to secure it on the bottom surface of the platform. A guide member is attached to or integral with the end of the spring member to allow the user to move the engagement member out of the slot in order to disengage the mounting assembly from the platform of the skateboard. A wheel mount securing mechanism secures the engagement member of the wheel mount in the slot of the wheel mount connector. In a preferred embodiment, the wheel mount securing mechanism comprises a spring-biased button in a button aperture located on the guide member. Preferably, the button is automatically biased outward when the engagement member is received in the slot such that the user must push the button to overcome the spring force to allow him or her to slide the guide mechanism upward to disengage the wheel mount from the wheel mount connector. In an alternative embodiment, a spring-driven ball in the wheel mount cooperates with a detent in the guide member to hold the guide member in position, thereby preventing the engagement member from moving out of the slot. In yet another embodiment, a slide mechanism mounted on the platform has a retainer bar that slides into a channel in the engagement member to prevent the engagement member from coming out of the slot. A bar lock member can cooperatively engage a detent on the retainer bar to prevent it from sliding out of the channel.

In another embodiment, the wheel mounting assembly comprises a generally resilient outwardly extending member that is configured to engage a securing assembly on the platform so as to secure the wheel mounting assembly to the bottom surface thereof. The outwardly extending member has a locking projection that engages a locking cavity on the securing assembly. The resilient nature of the outwardly extending member assists in pushing the locking projection into the locking cavity. In yet another embodiment, the securing assembly comprises a ramp section that guides the locking projection into engagement with the locking cavity. The securing assembly can also comprise an extension member, which is slidably engaged in a base member attached to the bottom surface of the platform, that is configured to engage a locking aperture on the wheel mount of each of the wheel mounting assemblies.

The removable wheel mounting assembly of the present invention is particularly useful for wheeled objects that can benefit from a platform or deck that is in multiple sections, such as a disassemblable skateboard, for improved portability and storage. In one embodiment, the wheeled object includes a platform comprised of a first end section, a second end section and a center section disposed therebetween. The platform sections are configured to join to together to form an integral platform suitable for riding or for supporting other objects (i.e., if a dolly, cart, backpack, or etc.). A first wheel mounting assembly is at the junction of the first end section and the center section and a second wheel mounting assembly is at the junction of the second end section and center section. The first wheel mounting assembly abuttingly joins the first end section to the center section and the second wheel mounting assembly abuttingly joins the second end section to the center section to form the unitary platform or deck. The wheel mount connector can be provided in multiple components, with one on each of adjoining platform sections, that are joined by engagement with the wheel mount to secure the platform sections together.

Accordingly, the primary objective of the present invention is to provide a removable wheel assembly that provides the advantages discussed above and that overcomes the disadvantages and limitations associated with presently configured wheel assemblies.

It is also an object of the present invention to provide a removable wheel assembly that is configured to allow the wheels of a wheeled object to be quickly and easily removed from the object, typically from a platform or other mounting surface thereon, for storage and carrying and then easily reattached to the platform when the user desires to utilize the wheeled object.

It is also an object of the present invention to provide a removable wheel assembly that is adaptable for use with a wide variety of wheeled objects, including skateboards, roller skates, rollerblades, dollies, carts, backpacks, luggage and the like.

It is a further object of the present invention to provide a removable wheel mounting assembly that comprises a wheel mount connector that is integral with or attached to a platform or other mounting surface of a wheeled object and a wheel mount that is integral with or attached to a wheel assembly having an axle and one or more wheels.

It is a further object of the present invention to provide a removable wheel mounting assembly that has a wheel mount connector which is integral with or attached to a platform or other mounting surface of a wheeled object that is engagedly received in a twist-and-lock manner in the cavity of a wheel mount which is integral with or attached to a wheel assembly.

It is a further object of the present invention to provide a wheel mounting assembly that is configured to securely join adjacent platform sections together to provide a unitary platform for riding on or for supporting other objects.

The above and other objectives of the present invention will be explained in greater detail by reference to the attached figures and the description of the preferred embodiment which follows. As set forth herein, the present invention resides in the novel features of form, construction, mode of operation and combination of processes presently described and understood by the claims.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, and particularly with regard to the embodiment of the removable wheel mounting assembly of the present invention illustrated in the figures, various preferred embodiments of the present invention are set forth below. The enclosed description and drawings are merely illustrative of preferred embodiments and represent several different ways of configuring the present invention. Although specific components, materials, configurations and uses of the present invention are illustrated and set forth in this disclosure, it should be understood that a number of variations to the components and the configuration of those components described herein and in the accompanying figures can be made without changing the scope and function of the invention set forth herein.

Figure 1:
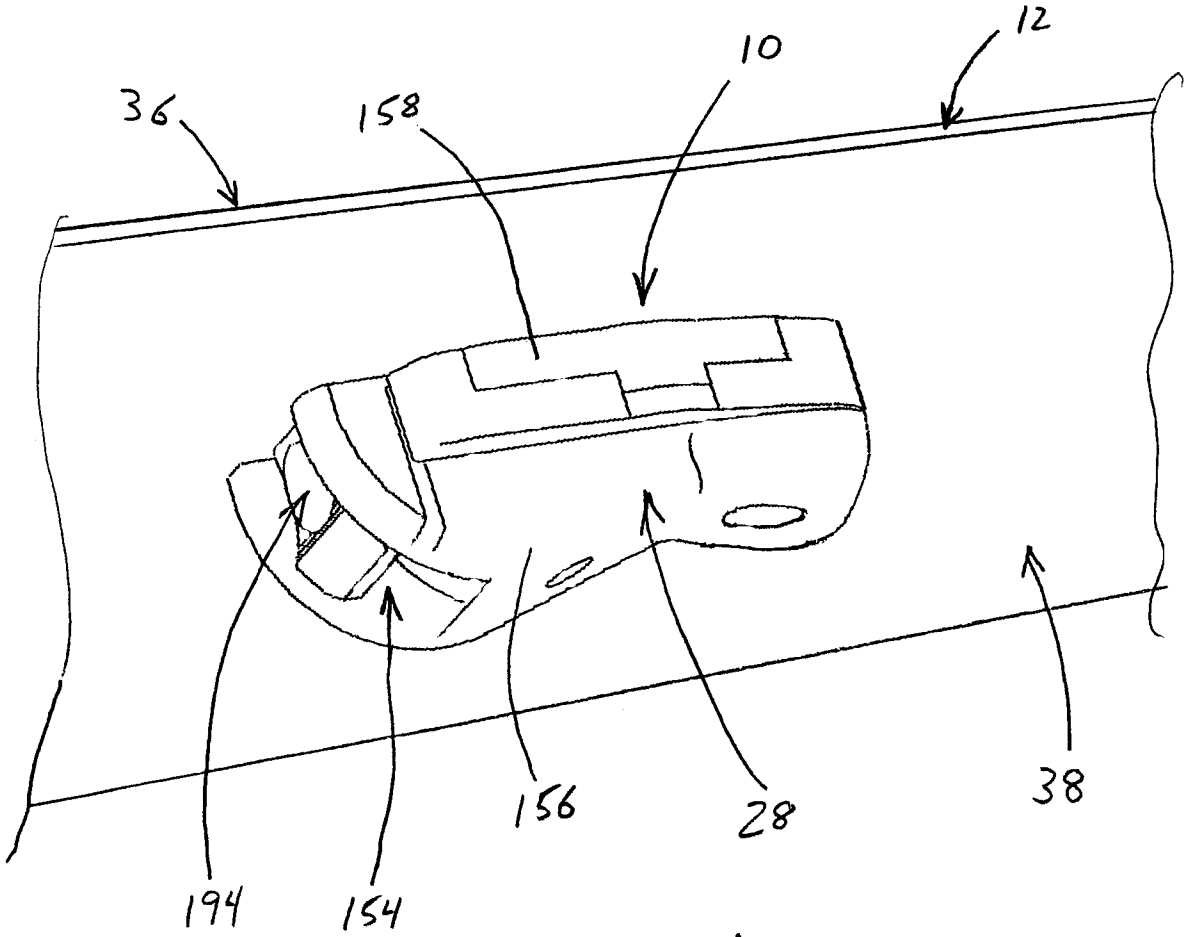
FIG. 1 is a bottom perspective view of the bottom surface of a platform with the wheel mounting assembly of the preferred embodiment of the present invention shown attached thereto.
Figure 27:
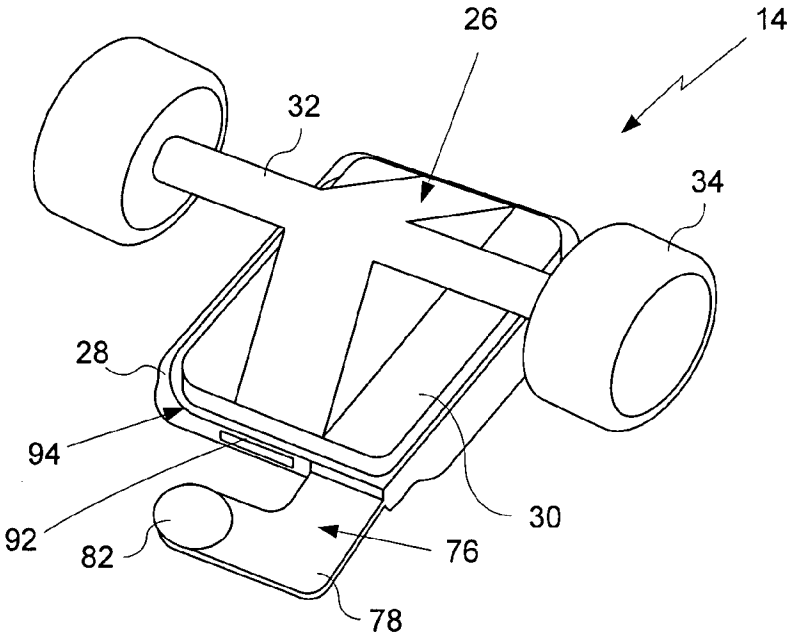
FIG. 27 is a bottom perspective view of one of the wheel mounting assemblies of the disassemblable skateboard of FIG. 22.

In the preferred embodiments of the removable wheel assembly of the present invention, shown in the figures, the wheel mounting assembly is identified generally as 10. FIG. 1 shows wheel mounting assembly 10 located on the bottom surface 38 of a platform 12 having an opposite facing top surface 36. As explained in more detail below and shown in FIGS. 2 and 3, wheel mounting assembly 10 primarily comprises two main components, a wheel mount 28 that attaches to or is integral with a wheel assembly 26, an example of which is shown in FIG. 27 with regard to use with a skateboard truck assembly, and a wheel mount connector 64 that attaches to or is integral with the bottom surface of platform 12. For purposes of use with the wheel mounting assembly 10 of the present invention, platform 12 can be any type of component associated with a wheeled object that provides a mounting surface suitable for wheel mount connector 64 to attach such that it may be operatively engaged by wheel mount 28 thereon. For instance, as set forth below, platform 12 can be an integral component of the wheeled object, such as the deck of a skateboard, shown as 13 in FIG. 21, or the bottom portion or member, such as a bottom plate or frame member, of a backpack, shoes, roller skates, dolly, furniture or the like that is useful for attachment of wheel assembly 26 thereto (typically a downwardly facing portion thereof). Although these various wheeled objects, as well as others, are not specifically shown in the accompanying figures, their configuration and uses are well known and are intended for use with wheel mounting assembly 10 of the present invention. Generally, but not exclusively, the platform 12 portion of the wheeled object, such as skateboard 13, will be made out of metal, wood, plastic, hard rubber or other material, or combinations of materials, that is sufficiently rigid to attach wheel mount connector 64 to a mounting surface thereof, such as bottom surface 38. In some circumstances, it may be possible to attach mount connector 64 directly to the wheeled object itself without the use of a separate platform 12, such as to the bottom of a backpack or piece of luggage. With some materials and certain wheeled object configurations, it may be beneficial to manufacture wheel mount connector 64 integral with platform 12 (i.e., molded therewith). For some devices and/or configurations, it may be beneficial or necessary to have wheel mount connector 64 attached to or integral with the top surface 36 of platform 12, instead of, or possibly in conjunction with, bottom surface 38.

Figure 24:
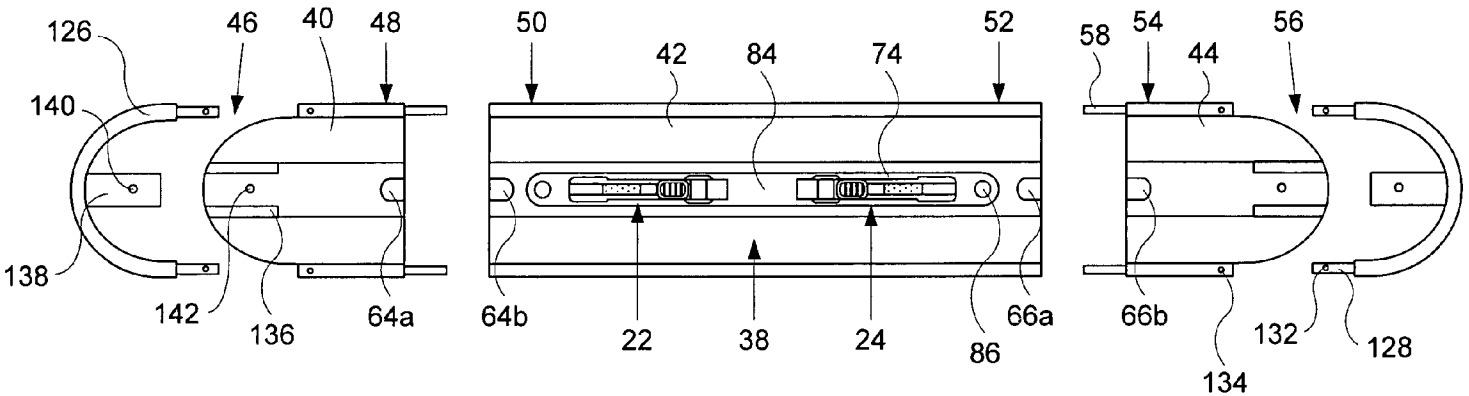
FIG. 24 is an exploded view of the disassemblable skateboard of FIG. 23 particularly showing the separate sections of the platform.

In the preferred embodiments of the present invention, wheel mounting assembly 10 cooperatively engages wheel mount connector 64 through a twist-and-lock type of connection. To provide this type of connection, wheel mount 28 has a mounting cavity 68 with one or more receiving lips 70 and wheel mount connector 64 has one or more projecting lips 72. In the embodiment shown in FIGS. 1 through 9, mounting cavity 68 has a pair of opposite disposed receiving lips 70*a* and 70*b* and wheel mount connector 64 has a pair of opposite disposed projecting lips 72*a* and 72*b*, as best shown in FIG. 24. Mounting cavity 68 of wheel mount 28 is sized and configured to receive wheel mount connector 64 therein. As known to those familiar with twist-and-lock operation, mounting cavity 68 is configured to be placed over wheel mount connector 64 at a right angle to the normal, mounted direction and then the wheel mounting assembly 10, typically having wheel assembly 26 attached thereto, is twisted to place the assemblies in the correct direction such that projecting lips 72 of wheel mount connector 64 engages receiving lips 70 of mounting cavity 68 on wheel mount 28 by receiving lips 70 slidably moving under projecting lips 72. Receiving lips 70 and projecting lips 72 should be configured such that receiving lips 70 of mounting cavity 68 are securely engaged by projecting lips 72 of wheel mount connector 64.

In the embodiment shown, first receiving lip 70*a* and second receiving lip 70*b* cooperatively engage, respectively, first projecting lip 72*a* and second projecting lip 72*b*. As shown, first projecting lip 72*a* and second projecting lip 72*b* extend outwardly from wheel mount connector 64 in opposite directions such that projecting lips 72*a* and 72*b* of wheel mount connector 64 engages receiving lips 70*a* and 70*b*, respectively, of wheel mount 28 by the receiving lips 70*a* and 70*b* slidably moving under projecting lips 72*a* and 72*b*. Receiving lips 70*a* and 70*b* and projecting lips 72*a* and 72*b* should be somewhat cooperatively configured such that receiving lips 70*a* and 70*b* of mounting cavity 68 are securely engaged by projecting lips 72*a* and 72*b* of first wheel mount connector 64 to securely hold wheel mounting assembly 10 on the bottom surface 38, or other mounting surface, of platform 12.

Figure 2:
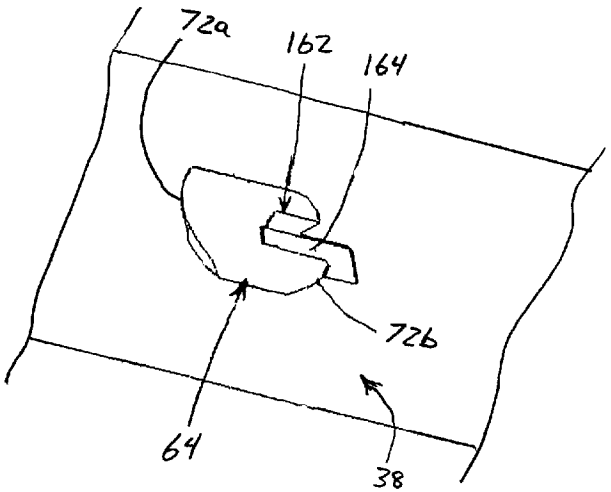
FIG. 2 is a bottom perspective view of the bottom surface of the platform of FIG. 1 showing the wheel mount connector of the preferred wheel mounting assembly.
Figure 3:
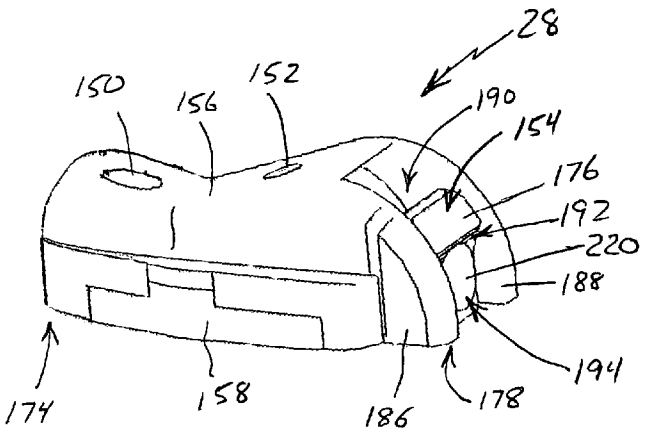
FIG. 3 is a top perspective view of a wheel mount of the wheel mounting assembly of FIG. 1.
Figure 11:
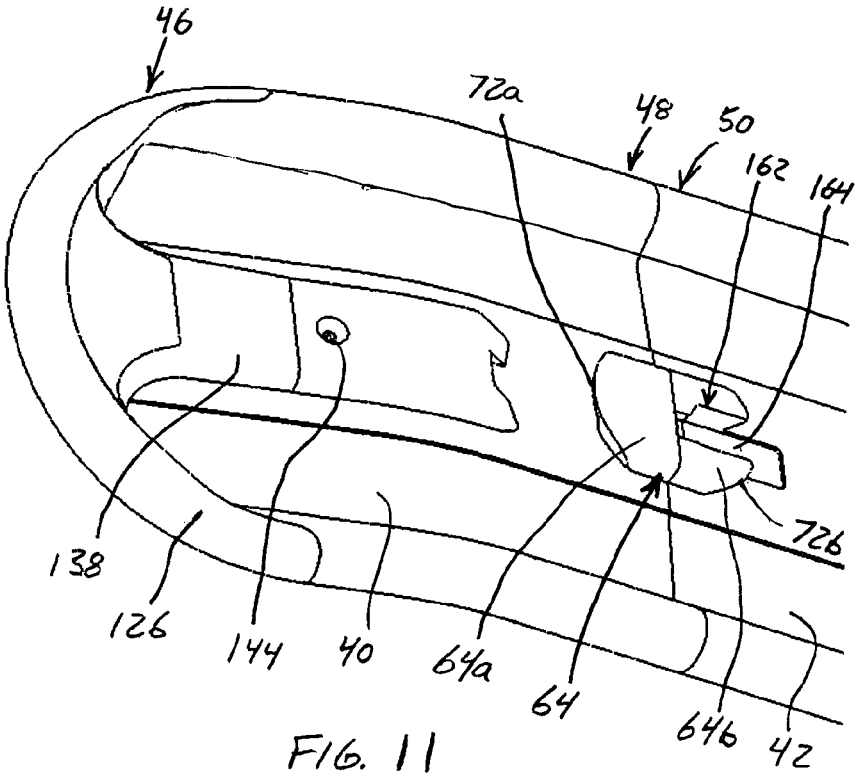
FIG. 11 is a bottom perspective view of the skateboard of FIG. 10 with the wheel mount removed from a two-piece wheel mount connector.
Figure 12:
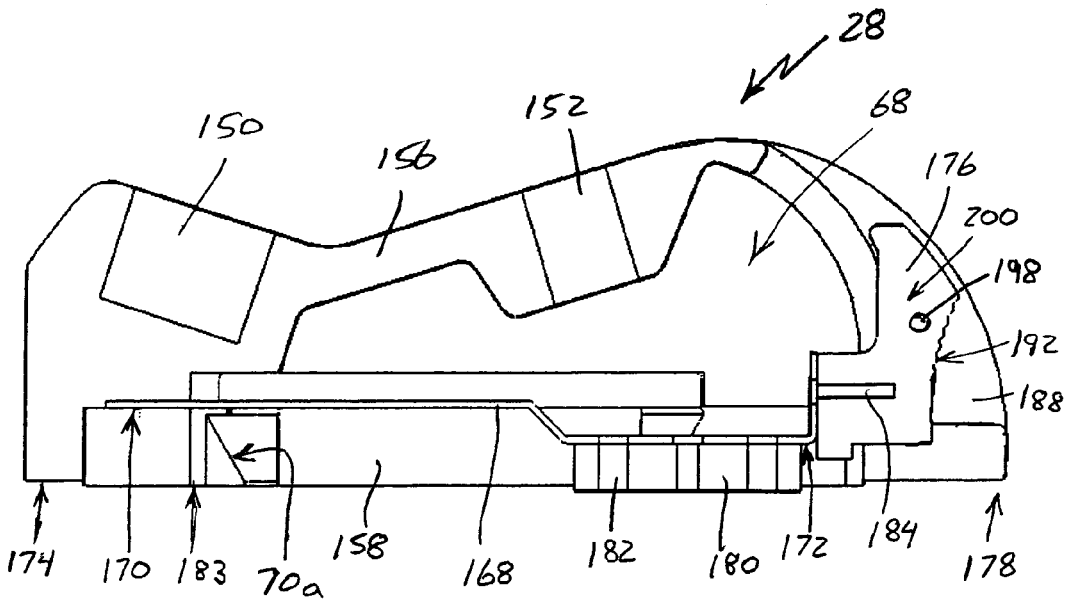
FIG. 12 is a cross-sectional side view of the wheel mount of FIG. 10 taken through the center of the wheel mount.
Figure 13:
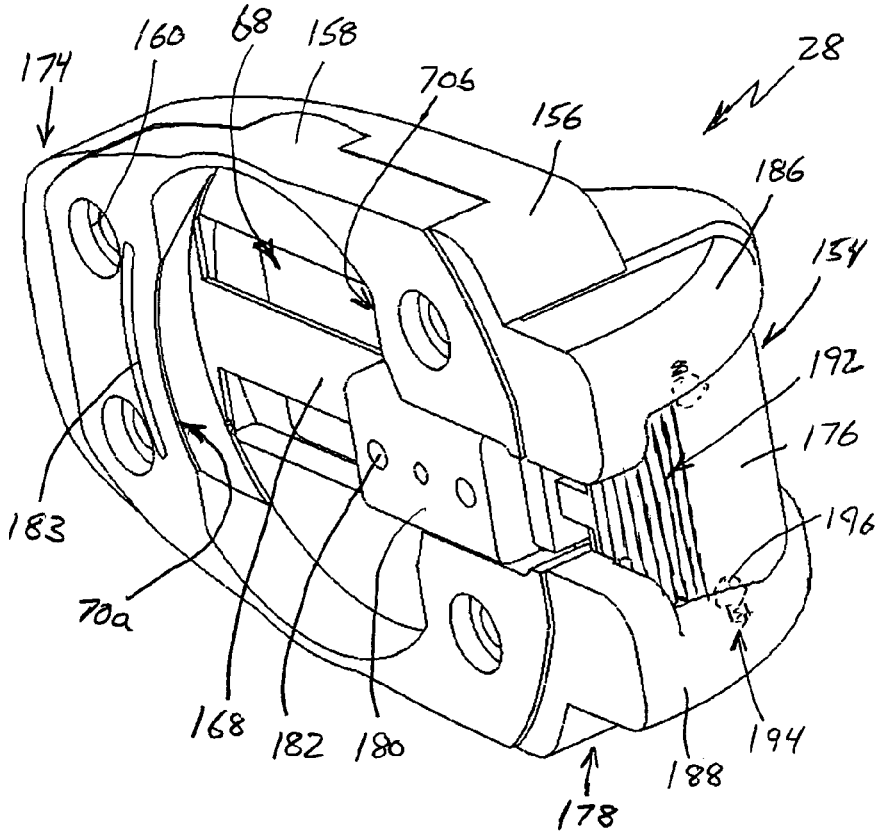
FIG. 13 is a bottom perspective view of the wheel mount of FIG. 10.

While the twist-and-lock configuration described above can be configured to be sufficient, on its own, to mount wheel mounting assembly 10 on bottom surface 38 of platform 12, to better ensure that wheel mount assembly 10 stays in place, the preferred configurations of the wheel mount 28 comprises a locking and/or securing mechanism that is configured to cooperate with wheel mount connector 64. In a preferred embodiment of the securing means, wheel mount connector 64 has a cut-out section 162 that defines a slot 164 which, in a preferred embodiment, extends into the bottom surface 38 of platform 12, as best shown in FIGS. 2 and 11, and wheel mount 28 has a latching mechanism 154. As explained in more detail below, wheel mount 28 is configured to slide over wheel mount connector 64 so latching mechanism 154 can cooperatively engage the cut-out section 162 and slot 164 to secure wheel mount 28, typically with wheel assembly 26, to platform 12 so as to form a generally integral wheeled object (i.e., skateboard 13). To facilitate the movement of wheel mount 28 over wheel mount connector 64 and the engagement of latching mechanism 154 with slot 164, the sides of wheel mount connector 64 can be sloped generally upward from the bottom surface 38 of platform 12. Typically, this slope will only need to be a gentle slope that facilitates the movement of the securing mechanism component of wheel mount 28 into the cut-out section 162 and slot 164.

As set forth above, and best shown in FIGS. 5,12,13 and 28, wheel mount 28 of the preferred embodiment comprises mounting cavity 68 defined by mount body 156 in which is operatively disposed latching mechanism 154. In the embodiment shown in FIGS. 10 through 20, latching mechanism 154 comprises an elongated spring member 168 having a first end 170 and a second end 172 that is disposed between mount body 156 and mount base 158 at its first end 170 near the first end 174 of wheel mount 28, a guide member 176 at second end 172 of spring member 168 that is positioned near the second end 178 of wheel mount 28 and an engagement member 180 attached to the spring member 168 near the guide member 176. Preferably, spring member 168 has one or more apertures 181, best shown in FIGS. 8, 9 and 15, that align with apertures 160 in mount base 158 so as to secure spring member 168 between mount base 158 and mount body 156 by the screws or other connectors used to attach mount base 158 to mount body 156. Spring member 168 is preferably manufactured out of a spring metal material such that, with its first end 170 secured between mount body 156 and mount base 158, it has sufficient flexibility to be directed upward into mounting cavity 68 when wheel mount 28 is twisted onto wheel mount connector 64. The width of mounting cavity 68 should be sufficient to extend over the length of mount connector 64 for installation of wheel mount 28 on to platform 12 and its removal therefrom.

The engagement member 180 is attached to spring member 168 such that the upward movement of spring member 168 from its contact against wheel mount connector 64 will move engagement member 180 upward so that it may slide across the top of wheel mount connector 64 to the slot 164. In the embodiment shown, one or more screws 182 are used to attach engagement member 180 to spring member 168. As will be readily understood by those skilled in the art, however, spring member 168 and engagement member 180 can be integrally formed or various other mechanisms, including adhesives, welding, bolts or other means for connecting these two components together can also be utilized. Engagement member 180 is shaped and configured to fit within the slot 164 defined by cut-out section 162 and securely hold, along with the receiving lips 70 and projecting lips 72, wheel mount 28 on wheel mount connector 64. In the preferred embodiments, engagement member 180 tightly fits into slot 164 to prevent any wobbling or other undesirable movement of wheel mounting assembly 10 when attached to platform 12. When wheel mount 28 is placed on wheel mount connector 64 and then twisted or rotated into position, the receiving of engagement member 180 into cut-out section 162 and slot 164 prevents further rotation of wheel mount 28, thereby preventing any unintended and undesirable disengagement of wheel mount 28, and therefore wheel mounting assembly 10, from platform 12. Preferably, mount base 158 is provided with a relief cut 183, best shown in FIG. 13, near the first end 174 of wheel mount 28 to allow give in the material for mount base 158 when wheel mount 28 is mounted on wheel mount connector 64.

Figure 14:
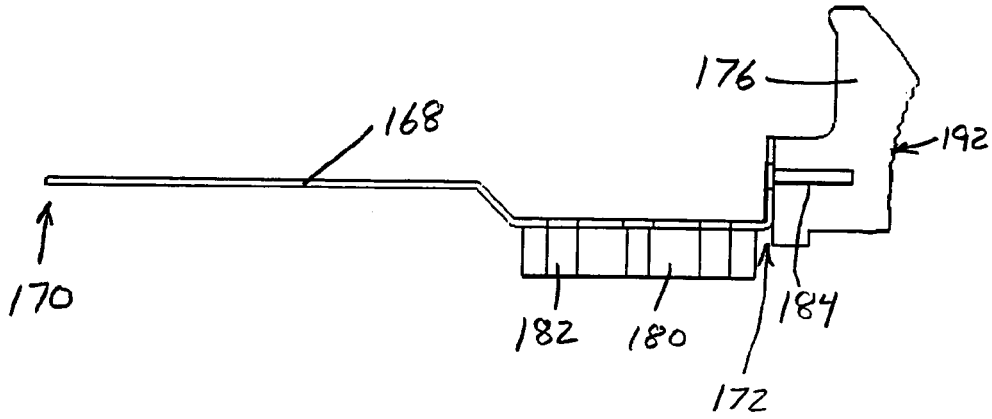
FIG. 14 is a side cross-sectional view of the spring locking mechanism of the wheel mount of FIG. 10.
Figure 15:
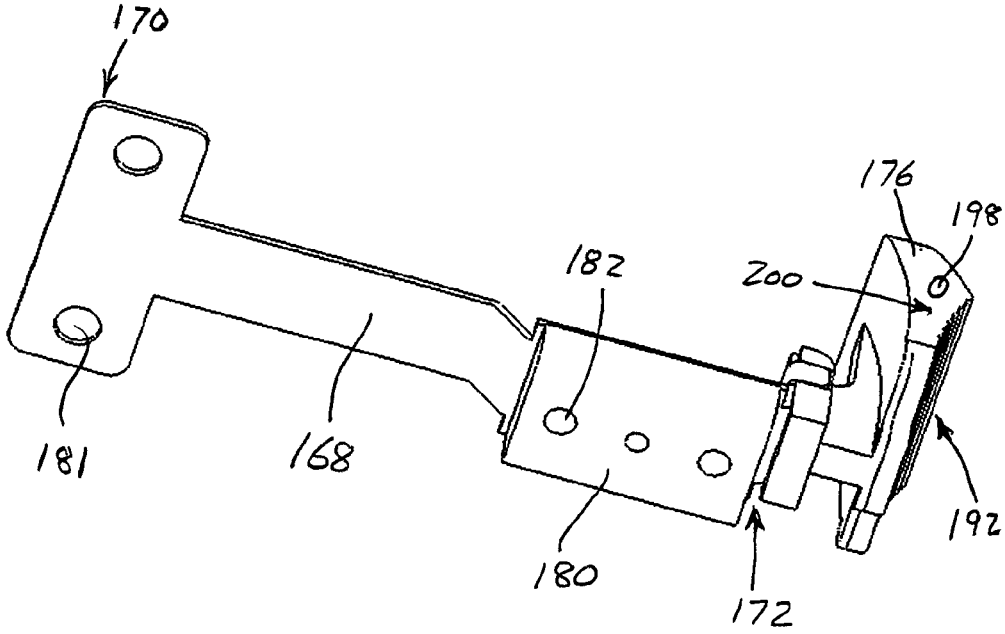
FIG. 15 is a bottom perspective view of the spring locking mechanism of FIG. 14.

Guide member 176 is configured for controlled release of engagement member 180 from slot 164 and, therefore, wheel mount 28 from wheel mount connector 64. In the preferred embodiments, as best shown in FIGS. 8, 9, 14 and 15, guide member 176 is attached to the second end 172 of spring member 168 with one or more connecting elements, such as screw 184. In the embodiment of FIGS. 14 and 15, spring member 168 has an upwardly extending portion 186 at its second end 172 which abuts the back side of guide member 176 to facilitate its attachment thereto. Alternatively, guide member 176 can be integral with second end 172 of spring member 168 or with upwardly extending portion 186. Guide member 176 is disposed between a pair of guide member supports 186 and 188, which define a guide cavity 190 (best shown in FIGS. 3, 6 and 10) at the second end 178 of wheel mount 28 in a manner that allows guide member 176 to be slidably disposed therebetween. Because guide member 176 is attached or integral to the second end 172 of spring member 168, the upward sliding movement of guide member 176 in guide cavity 190 will pull spring member 168 and, therefore, engagement member 180, upward into mounting cavity 68. This upward movement of guide member 176 will remove engagement member 180 from the cut-out section 162 and slot 164 to allow the twisting or rotation of wheel mount 28 so that it may be removed from wheel mount connector 64. In the preferred embodiments, guide member 176 has a ridge section 192 with a plurality of ridges, as is familiar to those skilled in the art, that is contacted by the user with his or her thumb or finger to move guide member 176 upward to remove the mounting assembly 10 from platform 12.

As discussed above, while latching mechanism 154 can be configured to substantially secure wheel mount 28 to wheel mount connector 64 without the need of additional securing mechanisms, it is preferred that a "back-up" or secondary securing mechanism also be utilized. Such a secondary wheel mount securing mechanism or means is shown as 194 in FIGS. 1, 3-9, 12, 13 and 15, with the preferred configuration being shown in FIGS. 6, 7 and 9. One advantage of the securing mechanism 194 shown in these figures is that the bottom surface 38 of platform 12 does not require any further components, such as the first 22 or second 24 securing mechanisms described in some of the alternative embodiments of wheel mounting assembly 10 set forth below. In the alternative embodiment of FIGS. 12, 13 and 15, wheel mount securing mechanism 194 comprises a spring-driven ball 196 disposed in one or both of the guide member supports 186 and 188 that is configured to be received in a cooperatively positioned detent 198 on the sides 200 of guide member 176. Wheel mount securing mechanism 194 is configured to bias ball 196 outward into guide cavity 190 when guide member 176 is not in its lowered, locked position. As guide member 176 is pushed downward by the user, the sides 200 of guide member 176 will push the ball 196 into guide supports 186/188 until the detent 198 is aligned with the position of ball 196, at which time the mechanism 194 will bias the ball 196 partially into detent 198 to effectively lock guide member 176 in place. Preferably, the movement of ball 196 into detent 198 is accomplished with a "click" action, as known to those in the art, that can be felt and/or heard by the user. As such, the installation of wheel mount 28 onto platform 12 is a two-step process, the first being the placement and twisting of wheel mount 28 onto wheel mount connector 64 and the second being the downward push on guide member 176 to engage the wheel mount securing mechanism 194. Once guide member 176 is pushed downward to engage ball 196 into detent 198, the guide member is locked in position, thereby holding engagement member 180 inside the cut-out section 162 and slot 164 of the wheel mount connector 164 to prevent wheel mount 28 from becoming disengaged from wheel mount connector 64 when the wheeled object, such as skateboard 13, is in use.

Figure 16:
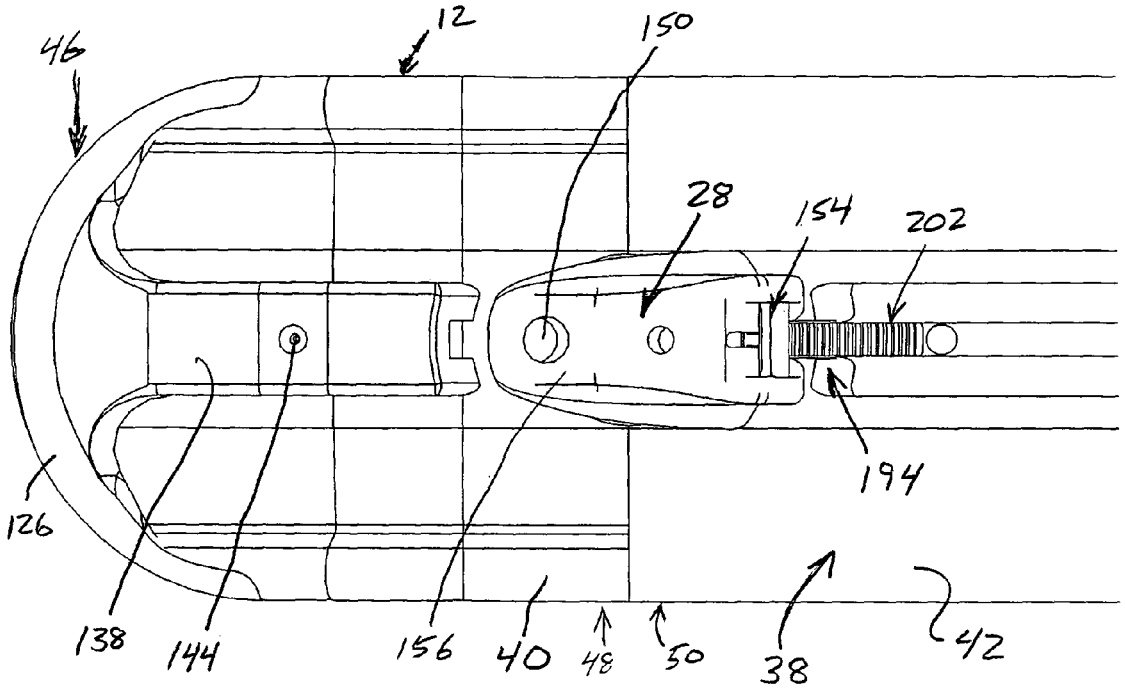
FIG. 16 is a bottom view of a skateboard showing another alternative embodiment of the wheel mounting assembly of the present invention illustrating the use of a slide mechanism to secure the wheel mount to the wheel mount connector.
Figure 17:
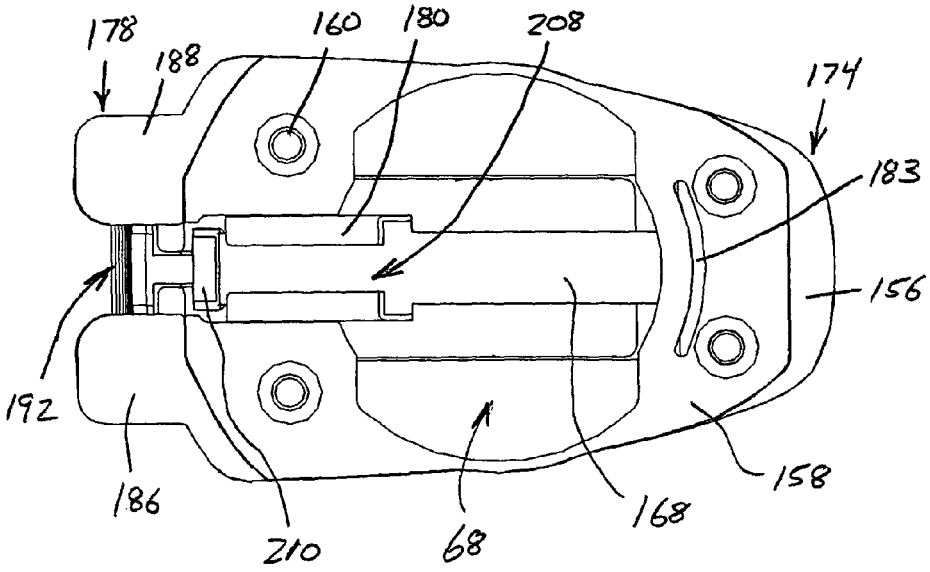
FIG. 17 is a bottom view of a wheel mount configured for use with the slide mechanism of FIG. 16.
Figure 18:
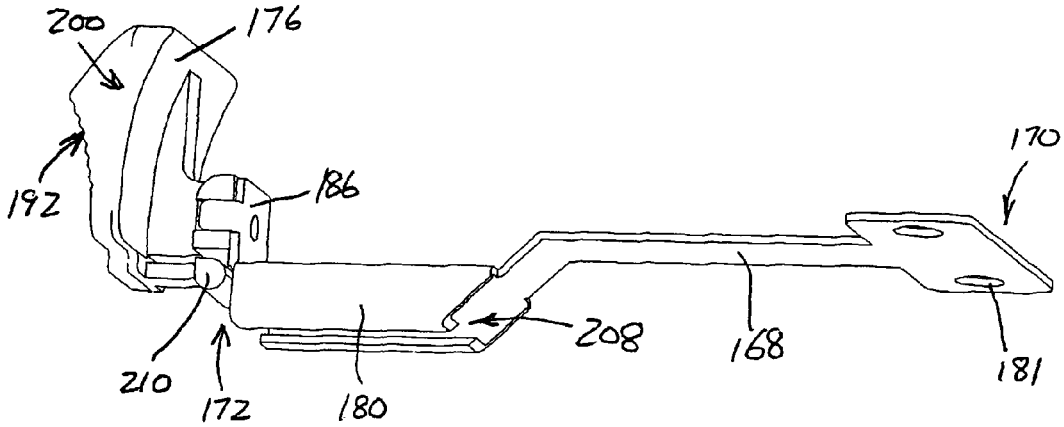
FIG. 18 is a side perspective view of the spring locking mechanism configured for use with the slide mechanism of FIG. 16.
Figure 19:
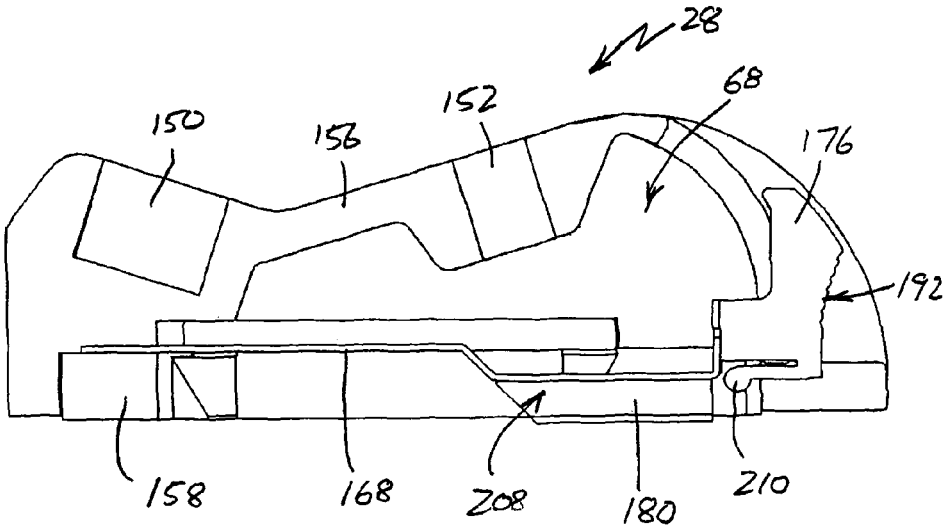
FIG. 19 is a side cross-sectional view of the wheel mount configured for use with the slide mechanism of FIG. 16.
Figure 20:
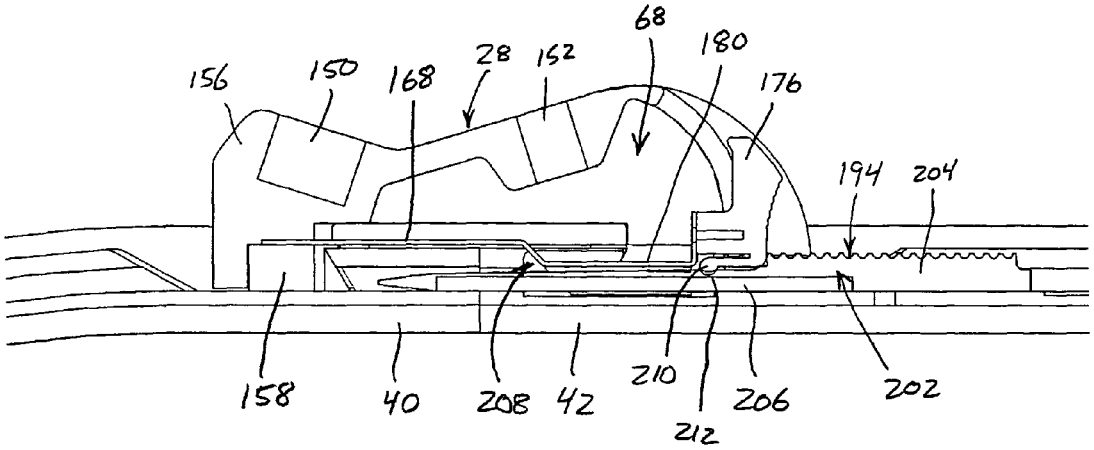
FIG. 20 is a cross-sectional side view of the embodiment of FIG. 16 showing the slide mechanism engaging the wheel mount to secure the wheel mount to the platform.

An alternative embodiment of wheel mount securing mechanism 194, shown in FIGS. 16 through 20, comprises a slide mechanism 202 having a slide member 204 and a retainer bar 206 slidably mounted on the bottom (the mounting) surface 38 of platform 12 and a channel 208 in engagement member 180 of wheel mount 28. The slide member 204 is configured to be operated by the user so as to direct the retainer bar 206 into and out of channel 208, best shown in FIGS. 17, 18 and 19, after wheel mount 28 is placed on wheel mount connector 64 and then twisted into position thereon. FIGS. 16 and 20 show the retainer bar 206 received inside channel 208 to substantially lock wheel mount 28 to wheel mount connector 64. When retainer bar 206 is positioned in channel 208 of engagement member 180, the guide member 176 will not be able to move upward to disengage wheel mount 28 from wheel mount connector 64 until the user manually operates slide mechanism 202. To unlock wheel mount 28 from wheel mount connector 64, the user merely moves slide member 204 away from wheel mount 28, which is to the right in the figures, so as to move retainer bar 206 out of channel 208. To prevent unintended movement of slide member 204 away from wheel mount 28, which could allow wheel mount 28 to disengage from wheel mount connector 64, the preferred embodiment includes a bar lock member 210 that is attached to or integral with guide member 176, as best shown in FIGS. 18 through 20, which is configured to engage a detent 212, shown in FIG. 20, in retainer bar 206 as retainer bar 206 is slid into position in channel 208, thereby preventing retainer bar 206 from moving out of channel 208. Preferably, bar lock member 210 is part of a living hinge arrangement, best shown in FIGS. 19 and 20, that is automatically pushed upward by the inward movement of retainer bar 204 until it falls into position in detent 212. Once bar lock member 210 is in position in detent 212, it prevents any further movement, particularly outward movement, of retainer bar 204 to secure wheel mount 28 to platform 12. The user disengages wheel mount 28 from wheel mount connector 64 by moving guide member 176 slightly upward to separate bar lock member 210 from the detent 212 in retainer bar 204 and then moving slide member 204 away from wheel mount 28 to slide retainer bar 206 out of channel 208. Once retainer bar 206 is out of channel 208, the user can twist wheel mount 28 to an approximate right angle and then lift wheel mount 28, and its associated wheel assembly 26, off of wheel mount connector 64.

In use for the embodiment of FIGS. 10 through 15, the user places wheel mount 28, typically with wheel assembly 26 attached thereto, over wheel mount connector 64 at a substantially right angle to its normal direction such that mounting cavity 68 fits over wheel mount connector 64. The user then twists or rotates wheel mount 28 into position, thereby causing engagement member 180 to contact the side of wheel mount connector 64, which results in the spring member 168 flexing upward to move engagement member 180 into mounting cavity 68. Continued twisting or rotating will cause engagement member 180 to drop into slot 164, defined by cut-out section 162, to lock wheel mount 28 onto wheel mount connector 64. In the embodiment of FIGS. 10 through 15, the user then moves guide member 176 downward to engage wheel mount securing mechanism 194 by pushing the spring-loaded ball 196 inward until detent 198 is aligned therewith, at which time ball 196 will move partially into the detent 198 and lock engagement member 180 in slot 164 to prevent any unintentional disengagement of wheel mount 28 from platform 12. When the user desires to remove wheel mount 28 from platform 12, he or she moves guide member 176 upward, pushing ball 196 back into guide member supports 186/188, to move engagement member 180 out of slot 164 and allow the user to twist/rotate wheel mount 28 to the right angle position so as to remove it from wheel mount connector 64. In the alternative embodiment of FIGS. 16 through 20 with slide mechanism 202, the user locks the wheel mount 28 to the wheel mount connector 64 by operating the slide member 204 to move the retainer bar 206 into channel 208, which is locked into place by the engagement of bar lock member 210 into detent 212 in retainer bar 206. The user removes wheel mount 28 from platform 12 by moving guide member 176 upward to separate bar lock member 210 from detent 212, sliding slide member 204 and retainer bar 206 away from wheel mount 28 and then twisting/rotating wheel mount 28 to its right angle position so that it can be removed from platform 12.

The preferred embodiment for the wheel mount 28 of the present invention is set forth in FIGS. 1 through 9. As discussed in more detail below, the preferred embodiment includes an improved wheel mount securing mechanism 194 for latching mechanism 154 that more securely maintains the connection between wheel mount 28 and wheel mount connector 64 and is easier to operate to secure or remove wheel mount 28 from platform 12. The wheel mount 28 of the present embodiment is configured to cooperatively engage the wheel mount connector 64 configured as shown in FIG. 2. Much of the above discussion with regard to the embodiment shown in FIGS. 10 through 15, with regard to latching mechanism 154, is also applicable to the embodiment of FIGS. 1 through 9, particularly as to the cooperation between and configuration of mount body 156, mount base 158 and spring member 168. In summary, the improvements to securing mechanism 194 provide a more reliable yet easy to use securing mechanism 194 to allow the user to attach wheel mount 28 to platform 12, in the twist-and-lock type configuration previously described, of the wheeled object, such as skateboard 13, or to remove it therefrom as may be desired for storage and/or transport.

Figure 5:
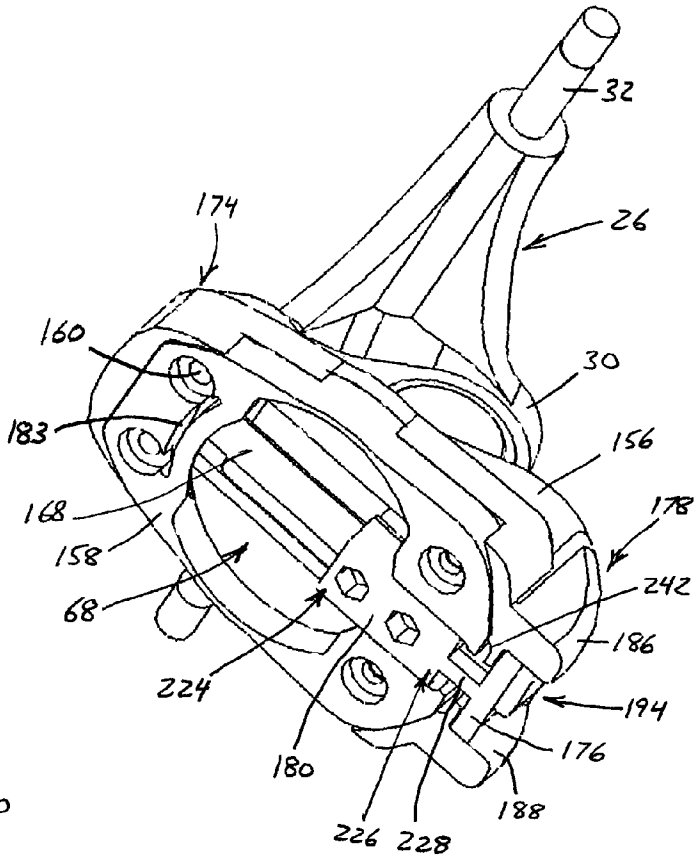
FIG. 5 is bottom perspective view of the wheel mount of FIG. 4.
Figure 4:
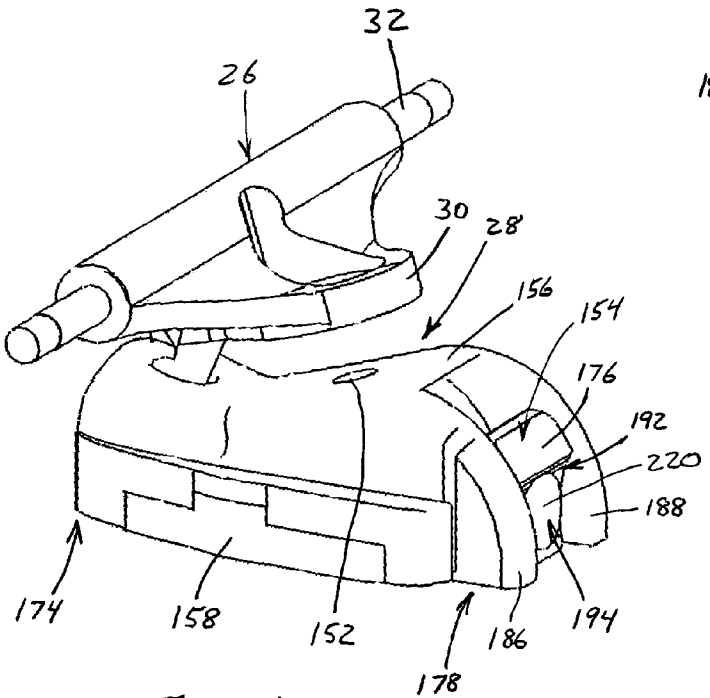
FIG. 4 is a top perspective view of the wheel mount of FIG. 3 shown with a portion of a wheel assembly attached thereto.

Wheel mount 28, shown with wheel assembly 26 (minus wheels 34) attached thereto in FIGS. 4 and 5, having the improved securing mechanism 194 includes button 220 that the user operates to move guide member 176 so as to engage or disengage wheel mount 28 from the wheel mount connector 64. As in the aforementioned embodiment, guide member 176 of latching mechanism 154 moves upward to move engagement member 180, which is attached to spring member 168, out of slot 164 defined by cut-out section 162 so the user may twist wheel mount 28 off of wheel mount connector 64 to remove wheel mount 28 from platform 12. As best shown in FIGS. 6 through 9 and described in more detail below, button 220 is received in button aperture 222 in guide member 176 in a manner that prevents guide member 176 from moving upward unless the user sufficiently pushes button 220 inward so as to overcome a biasing force that biases button 220 outward to unlock securing mechanism 194 and allow the user to move guide member 176 upward in guide cavity 190 and displace engagement member 180 from slot 164. Preferably, when the user installs wheel mount 28, typically with wheel assembly 26 attached thereto, securing mechanism 194 automatically locks guide member 176 in place (alternatively, the user moves guide member 176 downward), displacing button 220 outwardly, when engagement member 180 is received in slot 164.

Figure 6:
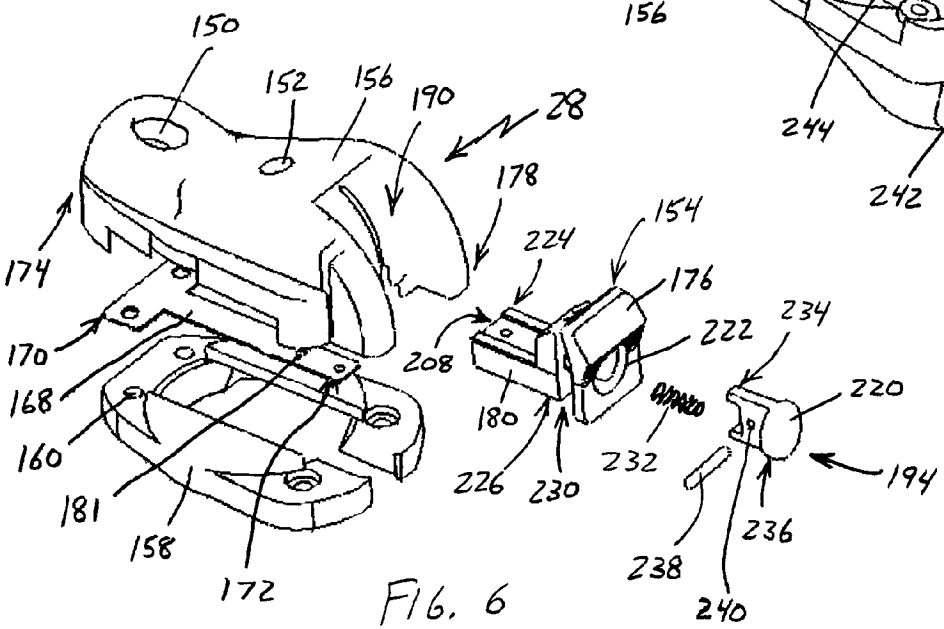
FIG. 6 is an exploded top perspective view of the wheel mount of FIG. 3.
Figure 9:
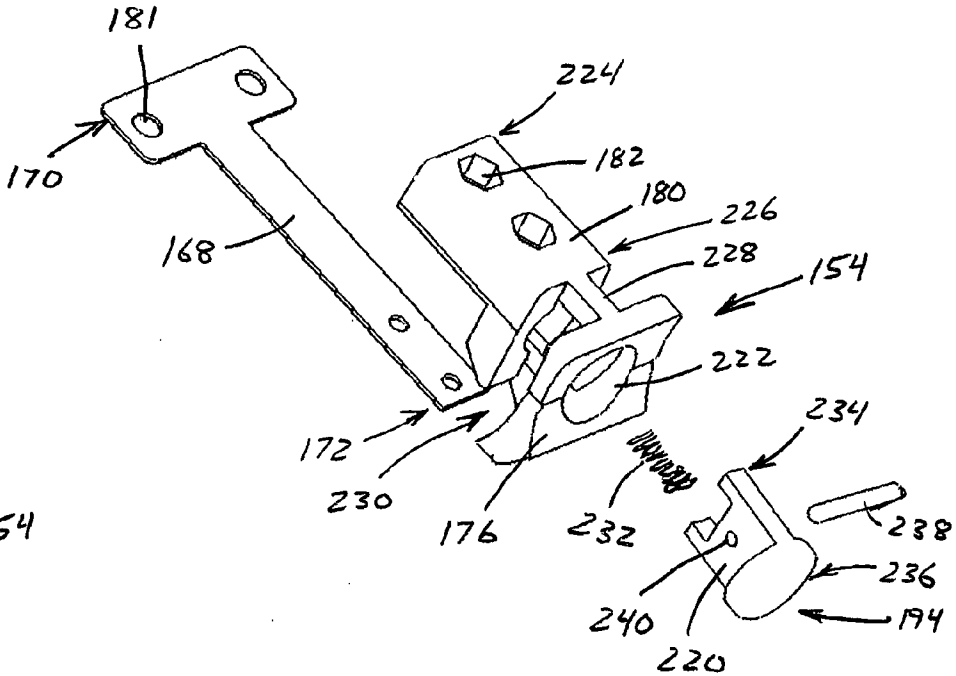
FIG. 9 is a partially exploded bottom perspective view of the latching mechanism of FIG. 8.
Figure 8:
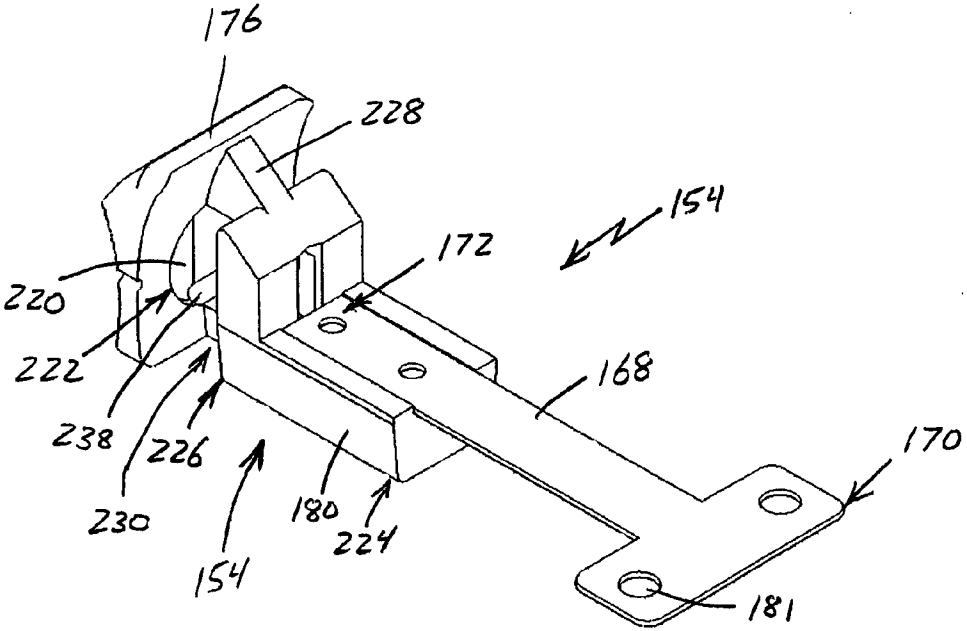
FIG. 8 is a top perspective view of the latching mechanism of the preferred embodiment of the wheel mounting assembly of the present invention.

As previously explained, the first end 170 of spring member 168, which is configured to be straight or substantially straight (or flat) in this embodiment, is secured between mount body 156 and mount base 158 to allow engagement member 180, attached to the second end 172 thereof, to flex upward during disengagement and downward during engagement of wheel mount 28 from wheel mount connector 64. As best shown in FIGS. 6 and 8, the second end 172 of spring member 168 is received into channel 208 beginning at the first end 224 of engagement member 180 and guide member 176 is located at the second end 226 of engagement member 180. Preferably, engagement member 180 and guide member 176 are integrally formed with a bridge section 228 that interconnects engagement member 180 and guide member 176, which placed are in spaced apart relation with a gap 230 substantially therebetween (except for bridge section 228). In the preferred embodiment, button 220 is biased outwardly by spring 232, as the biasing force, that is disposed between the first end 234 of button 220 and second end 226 of engagement member 180. As explained in more detail below, the user pushes against the second end 236 of button 220 to slide it in button aperture 222 to overcome the biasing force of spring 232 to allow guide member 176 to be slid upward in guide cavity 190.

Figure 7:
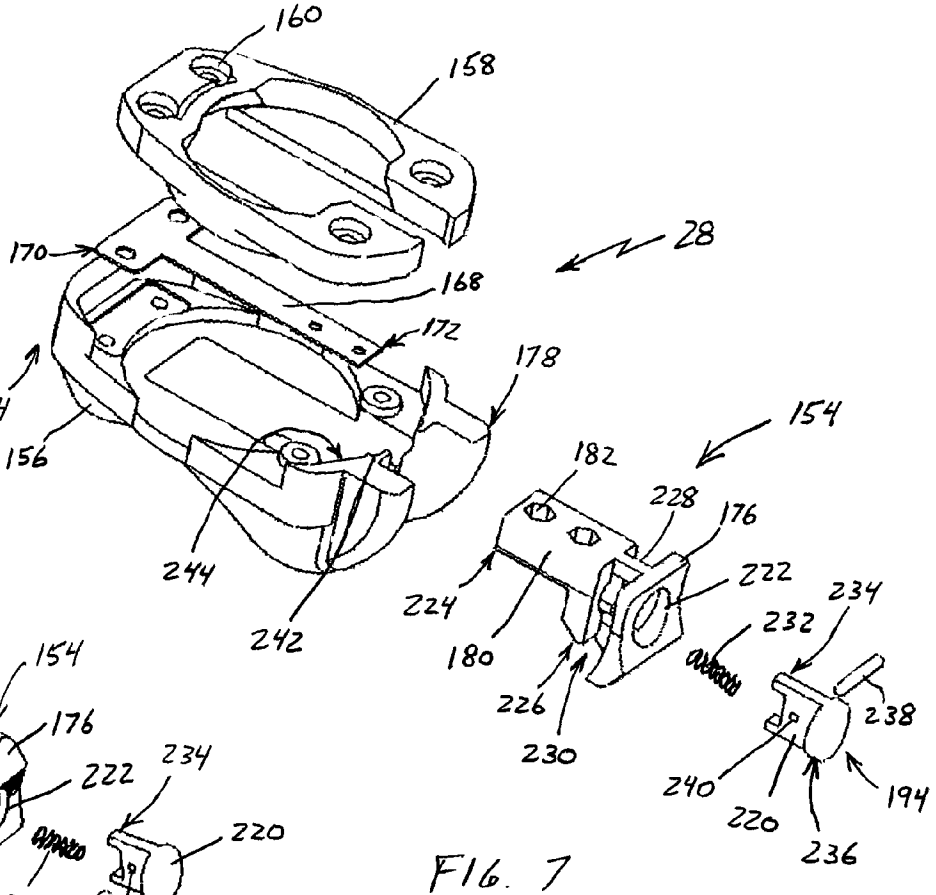
FIG. 7 is an exploded bottom perspective view of the wheel mount of FIG. 3.

When wheel mount 28 is twisted onto wheel mount connector 64, the biasing force of spring 232 will displace button 220 outward and lock it and guide member 176 in their locked position. To prevent button 220 from being displaced out of button aperture 222 during use of the wheeled object, such as skateboard 13, latching mechanism 154 includes slide rod 238 that is received in slide rod aperture 240 (the components being best shown in FIGS. 6, 7 and 9) in gap 230. To provide the locking desired for preventing unintentional disengagement of wheel mount 28 from wheel mount connector 64, securing mechanism 194 includes a rod engaging means that receives slide rod 238 and holds it in place until the user pushes against button 220 to release slide rod 238 and allow guide member 176 to be slid upward in guide cavity 190. In the preferred configuration of this embodiment, rod engaging means is a detent 242 located at the bottom edge of guide sidewall 244 of mounting cavity 68 near the second end 178 of wheel mount 28 behind guide cavity 190, as best shown in FIGS. 5 and 7. During normal operation (i.e., non-locked) of latching mechanism 154, slide rod 238 will be biased against guide sidewall 244 by the biasing force of spring 232 and will slide up and down guide sidewall 244 with the up and down movement of guide member 176. The biasing of slide rod 238 against guide sidewall 244 prevents button 220 from being displaced out of latching mechanism 154 through button aperture 222. When wheel mount 28 is placed on wheel mount connector 64, in the twist-and-lock manner described above, the movement of engagement member 180 into slot 164 will draw guide member 176 and button 220 downward (i.e., when wheel mount connector 64 is facing upward as shown in FIG. 2), either automatically or by the user pushing down on guide member 176, to cause slide rod 238 to move into detent 242. As will be readily understood by those skilled in the art, slide rod 238 and detent 242 are cooperatively configured such that slide rod 238 will be securely held in detent 242 until the user pushes inward on button 220 with enough force to overcome the biasing force of spring 232, at which time slide rod 238 will be displaced from detent 242 to slide along guide sidewall 244 of mounting cavity 68 with the movement of guide member 176 in guide cavity 190. In this manner, disengaging wheel mount 28 from platform 12 will require more than mere accidental contact against button 220, which contact may be possible depending on the use of the wheeled object to which it attaches.

Preferably, engagement member 180 is attached to the second end 172 of spring member 168 such that the upward movement of spring member 168, resulting from its contact against wheel mount connector 64, will displace the engagement member 180 upward into mounting cavity 68 so that it will slide across the top of wheel mount connector 64 to the slot 164 defined by cut-out section 162. When wheel mount 28 is placed on wheel mount connector 64 and then twisted or rotated into position, the receiving of engagement member 180 into cut-out section 162 and slot 164 prevents further rotation of wheel mount 28 and causes slide rod 238 to slide downward along guide sidewall 244 into detent 242, thereby preventing any unintended and undesirable disengagement of wheel mount 28, and therefore wheel mounting assembly 10 itself, from platform 12. Securing mechanism 194 of this embodiment is configured for controlled release of engagement member 180 from slot 164 and, therefore, wheel mount 28 from wheel mount connector 64 and platform 12. By the user pushing inward on button 220, with sufficient force to overcome spring 232, slide rod 238 is displaced from detent 242 so as to allow the user to move guide member 176 up guide cavity 190 and remove engagement member 180 from slot 164. The user then can twist or rotate wheel mount 28 relative to wheel mount connector 64 and remove wheel mount 28 from platform 12.

In use for the preferred embodiment of FIGS. 1 through 9, the user places wheel mount 28, typically with wheel assembly 26 attached thereto, over wheel mount connector 64 at a substantially right angle to its normal direction such that mounting cavity 68 fits over wheel mount connector 64. The user then twists or rotates wheel mount 28 into position, thereby causing engagement member 180 to contact the side of wheel mount connector 64, which results in the spring member 168 flexing upward to move engagement member 180 into mounting cavity 68. Continued twisting or rotating will cause engagement member 180 to drop into slot 164, defined by cut-out section 162, to lock wheel mount 28 onto wheel mount connector 64. As the engagement member 180 drops into slot 164, the slide rod 238 will slide along slide sidewall 244 until slide rod 238 moves into detent 242, allowing the biasing force of spring 232 to bias button 220 outward. This locks wheel mount 28 onto wheel mount connector 64 in a manner that prevents unintended disengagement of wheel mount 28 from platform 12. In a preferred embodiment, the guide member 176 moves into detent automatically. Alternatively, the user moves guide member 176 downward to engage wheel mount securing mechanism 194 and move slide rod 238 into detent 242 to lock engagement member 180 in slot 164. When the user desires to remove wheel mount 28 from platform 12, he or she pushes in on button 220 to disengage slide rod 238 from detent and then moves guide member 176 upward, allowing slide rod 238 to slide against guide sidewall 244, to allow the user to twist/rotate wheel mount 28 to the right angle position so as to remove it from wheel mount connector 64 and platform 12.

As stated above, the removable wheel mounting assembly 10 of the present invention can be utilized on a wide variety of wheeled objects, including but not limited to skateboards, roller skates, rollerblades, dollies, carts, racks, lifts, furniture, backpacks and luggage. The various wheeled objects can benefit from the wheel mounting assembly 10 of the present invention by allowing the user to remove the wheel assembly 26, by way of the removable wheel mount 28, from the supporting surface, such as the bottom surface 38, of the platform 12 attached to, incorporated in or integral with the wheeled object. The difference between the various wheeled objects will be the configuration of the wheel assembly 26 and, in some circumstances, how the wheel assembly 26 attaches to wheel mount 28. The use and configuration of wheel mount connector 64 will be substantially the same as that described above and in the embodiments below. For instance, the wheel assembly 26 for a skateboard 13 (the wheel assembly 26 is commonly referred to as a "truck") will be different than that for roller skates and rollerblades. However, the different configuration for the wheel assemblies 26 is readily adaptable to wheel mounting assembly 10 of the present invention.

Figure 10:
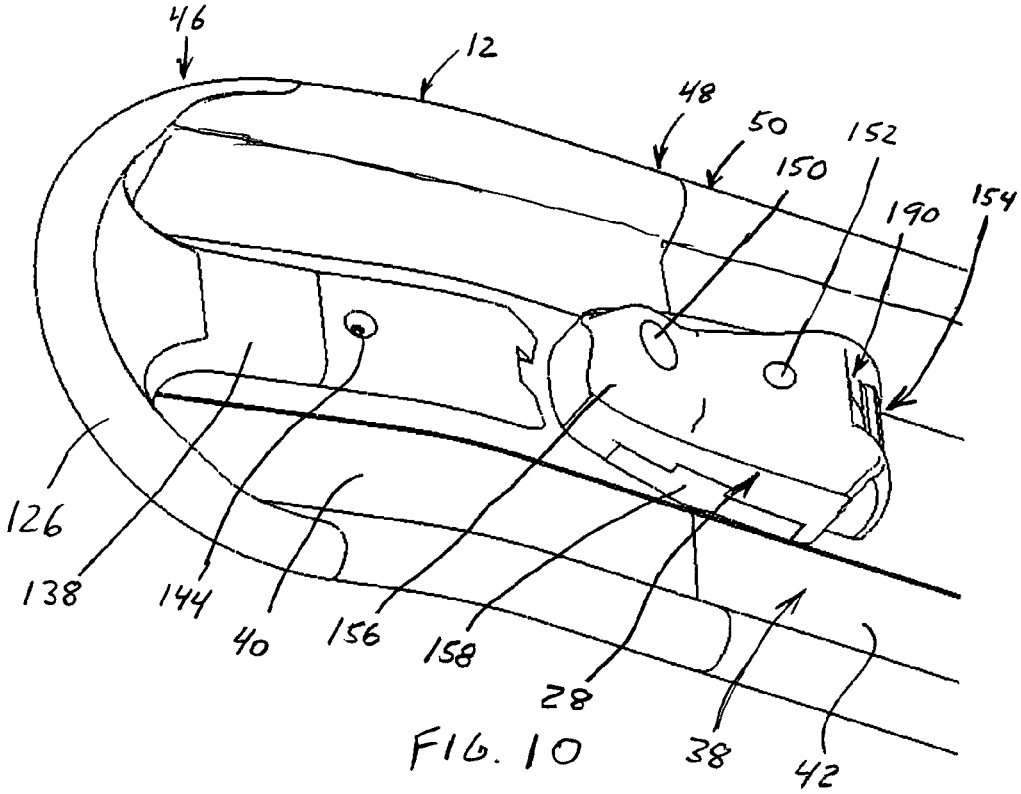
FIG. 10 is a bottom perspective view of a skateboard showing an alternative embodiment of the wheel mounting assembly of the present invention shown attached to the bottom surface of a skateboard to illustrate the first end section of the platform joined to the center section thereof with the wheel mount, without the wheel assembly, attached to the wheel mount connector.

As an example of a particularly beneficial use of the wheel mount assembly 10 of the present invention, the aforementioned embodiments are described in use with a skateboard 13, as shown in FIGS. 10, 11 and 16 with regard to the embodiments above and in FIGS. 21 through 37 in the various embodiments described below. As well known in the art, platform/deck 10 of skateboard 13 has a top surface 36 configured for the user to stand on and a bottom surface 38 to which, in the typical prior art skateboard, wheel base 30 of wheel assembly 26 attaches. In one configuration, skateboard 13 has a single piece platform 12 with removable first 14 and second 16 wheel mounting assemblies that enable the user to reduce the weight and bulk of skateboard 13 so as to more easily carry the components (i.e., platform 12, first wheel mounting assembly 14 and second wheel mounting assembly 16) separately for ease in distributing the weight and fitting within a backpack or other carrying case. As known to those familiar with skateboards, the conventional wheel assemblies are typically only removable by use of a screwdriver, wrench, hex driver or some other tool. Use of the single piece platform 12 with first 18 and second 20 mounting mechanisms and first 14 and second 16 wheel mounting assemblies of the present invention, as described in more detail below, allows the user to quickly and easily assemble skateboard 13 for riding or to quickly and easily disassemble skateboard 13 for storage or carrying. The heretofore available skateboards do not allow the user to essentially reduce skateboard 13 to a generally flat platform 12 and separate first 14 and second 16 wheel mounting assemblies in a quick and easy manner. Once separated or disassembled, the platform 12 can be carried, if desired, in a compartment separate from first 14 and second 16 wheel mounting assemblies.

Figure 23:
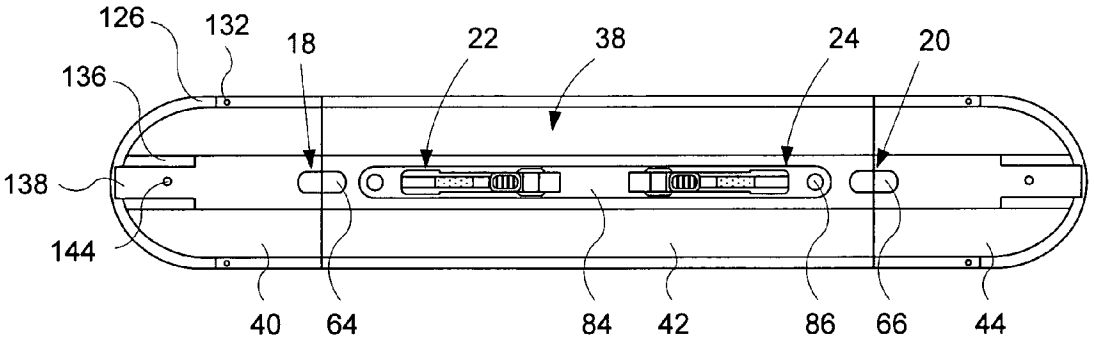
FIG. 23 is a bottom view of the disassemblable skateboard of FIG. 22 showing the platform with the wheel assemblies removed from the wheel mount connectors.

In a preferred embodiment, skateboard 13 has a platform 12 which can be separated into two or more separate platform sections. A disassemblable skateboard 13 utilizing wheel mounting assembly 10 of the present invention is the subject of co-pending patent applications. Generally, the disassemblable skateboard 13 has two or more platform sections, such as first end section 40, center section 42 and second end section 44 shown in FIG. 21, that are tightly joined together to form a substantially unitary platform (or deck) 12 for the rider to stand on. For purposes of describing the embodiments herein, first end section 40 has a first end 46 and a second end 48, center section 42 has a first end 50 and a second end 52, and second end section 44 has a first end 54 and second end 56. With regard to the embodiments above, the twist-and-lock operation is configured to join two adjoining platform sections together. In the preferred embodiment of skateboard 13, the joining of adjacent sections together is accomplished by utilizing a two-piece wheel mount connector 64, such as 64*a* at second end 48 of first end section 40 and 64*b* at first end 50 of center section 42 for first mounting mechanism 18 and 66*a* at second end 52 of center section 42 and 66*b* at first end 54 of second end section 44 for second mounting mechanism 20, as best shown in FIG. 24. In this manner, when first 40 and second 44 end sections are joined to center section 42, wheel mount connector components 64*a* and 64*b* will be abutting to form first wheel mount connector 64 and wheel mount components 66*a* and 66*b* will be abutting to form second wheel mount connector 66, as shown in FIG. 23. In the preferred embodiment of skateboard 13, wheel mount 28 of first wheel mounting assembly 14 will mount to first wheel mount connector 64 and a separate wheel mount 28 of the second wheel mounting assembly 16 will mount to second wheel mount connector 66 in a manner that cooperatively engages wheel mount 28 so as to hold first end section 40 to center section 42 and center section 42 to second end section 44 to form the unified platform (or deck) 12.

Figure 21:
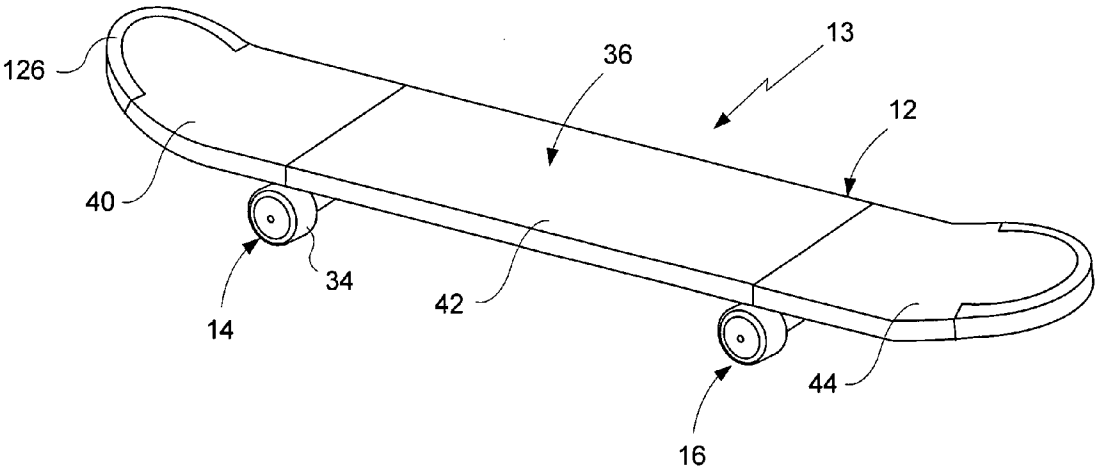
FIG. 21 is a top perspective view of a disassemblable skateboard for improved portability, shown in its assembled condition, that is utilizing a wheel mounting assembly of the present invention.
Figure 22:
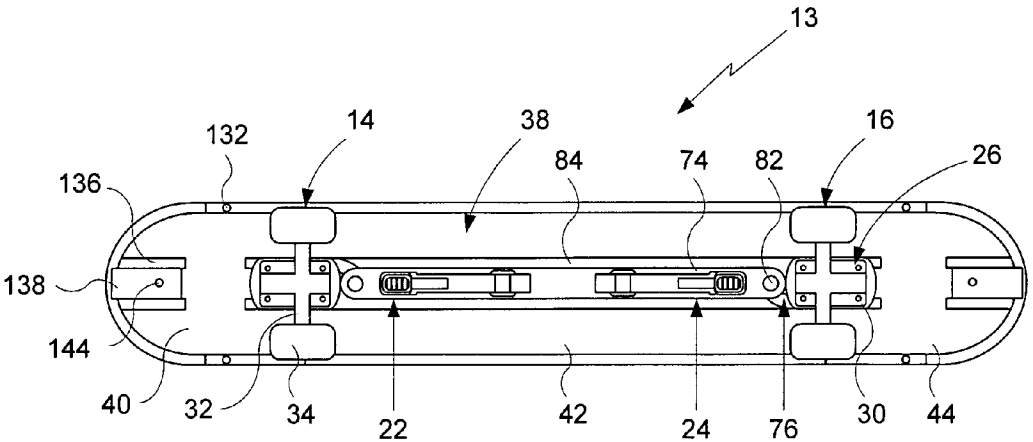
FIG. 22 is a bottom view of the disassemblable skateboard of FIG. 21 showing a pair of wheel mounting assemblies mounted and secured to the platform.
Figure 28:
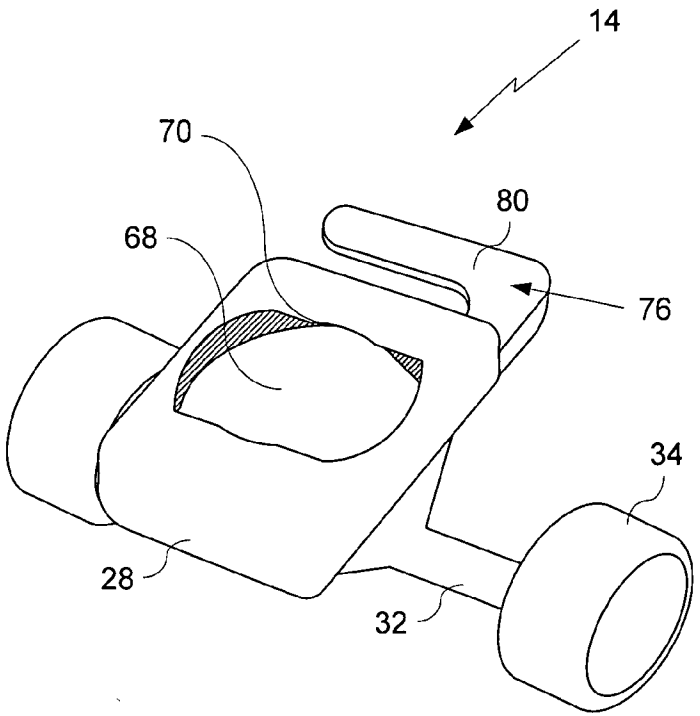
FIG. 28 is a top perspective view of the wheel mounting assembly of FIG. 27.

FIGS. 21 and 22 included herewith show a wheeled object, namely a portable, disassemblable skateboard 13 in its assembled or rideable condition, with the front or forward end of skateboard 13 on the left and the back or rearward end of skateboard 13 on the right. As shown in FIGS. 21 through 24, portable skateboard 13 primarily comprises platform/deck 12, a pair of wheel mounting assemblies 10 (namely a front or first wheel mounting assembly 14 and a rear or second wheel mounting assembly 16), front or first mounting mechanism 18, rear or second mounting mechanism 20, front or first securing mechanism 22 and rear or second securing mechanism 24. As shown in FIGS. 27 and 28 with regard to first wheel mounting assembly 14, with second wheel mounting assembly 16 being configured the same, each of the first 14 and second 16 wheel mounting assemblies comprise a wheel assembly 26 attached to or integral with wheel mount 28. Wheel assembly 26 of the preferred skateboard 13 is a standard wheel assembly that comprises a wheel base 30, axle 32 and a pair of wheels 34 rotatably attached to axle 32. As well known in the art, the heretofore available skateboards and wheel assemblies are typically configured such that wheel base 30 is attached directly to platform 12, with wheels 34 extending outwardly therefrom for riding on a sidewalk, street or other surface. Although wheel assembly 26 for first 14 and second 16 wheel mounting assemblies may be specially configured for the skateboard 13 that is used with wheel mounting assembly 10 of the present invention, it is preferred that wheel assembly 26 be one of the standard, typical or "high tech" wheel assemblies in use with presently available skateboards so as to reduce the cost and obtain the benefit of such presently existing wheel assemblies. As shown in the figures, it is preferred that wheel mount 28 be a separate component and wheel base 30 be fixedly attached thereto in the same manner as wheel base 30 for current wheel assemblies 26 attach to platform 12 (i.e., using screws, bolts, rivets, adhesives or other connecting mechanisms). In an alternative embodiment, wheel mount 28 can be made integral with wheel assembly 26 such that wheel mount 28 and wheel assembly 26 are a single component which attaches to platform 12 in the manner described below with regard to the preferred embodiment. As set forth in more detail above and in the text below, wheel mount 28 is configured to removably engage or attach to first mounting mechanism 18 or second mounting mechanism 20 so the user of skateboard 13 can remove first wheel mounting mechanism 14 and second wheel mounting mechanism 16 to reduce the size and configuration of skateboard 13 to make it easier to carry.

Figure 26:
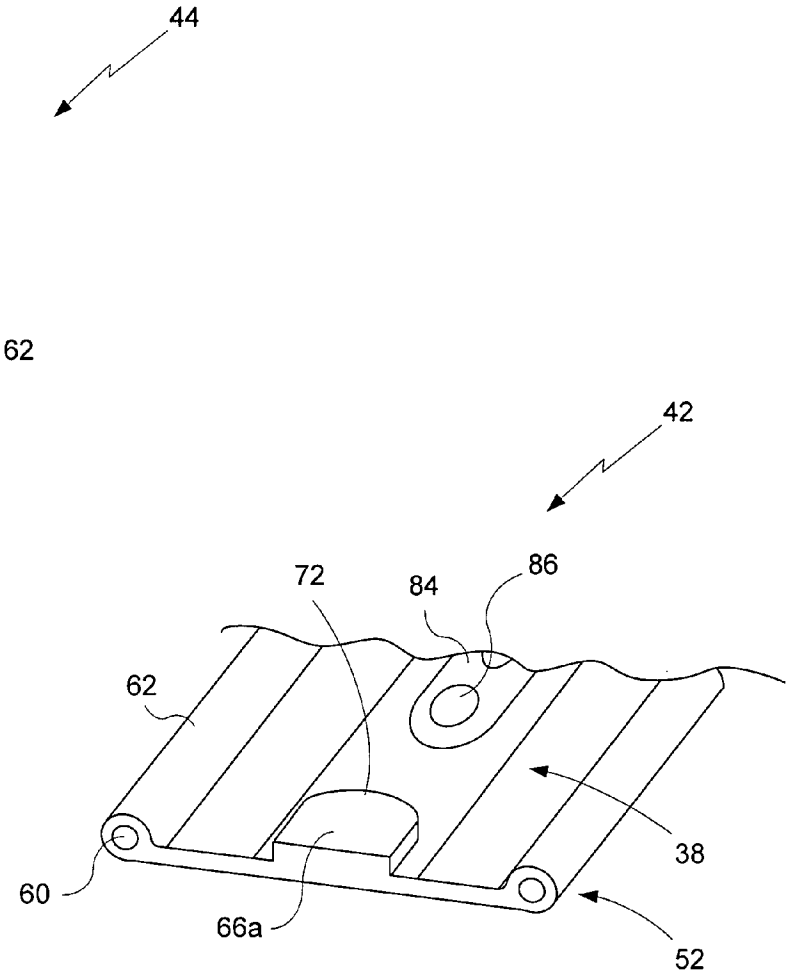
FIG. 26 is a rear perspective view of the second end of the center section of the platform of the disassemblable skateboard of FIG. 24.
Figure 25:
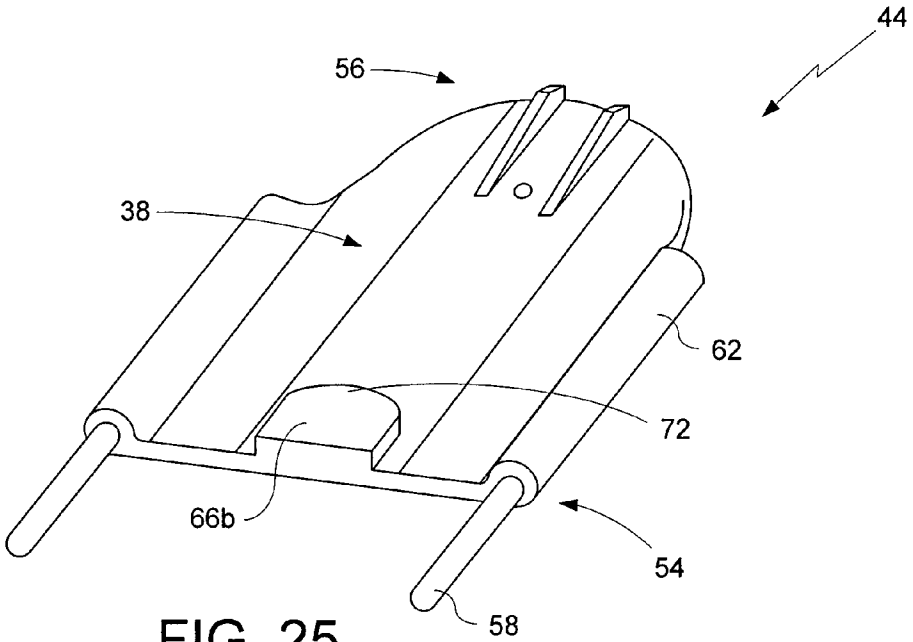
FIG. 25 is a front perspective view of the first end of the rearward end section of the platform of the disassemblable skateboard of FIG. 24.

In the preferred embodiments of skateboard 13, the separate sections of platform 12 are guided into the desired abutting relationship by use of a pin and socket type of arrangement. As best shown in FIGS. 25 and 26 with regard to second end section 44 and center section 42, respectively, the first end 54 of second end section 44 is provided with an outwardly extending pin 58 and second end 52 of center section 42 is provided with a cooperatively configured socket 60 which receives pin 58 therein when second end section 44 is joined to center section 42. As shown in FIG. 24, second end 48 of first end section 40 also has pins 58 and first end 50 of center section 42 also has sockets 60 to join first end section 40 to center section 42. In a preferred configuration, the outer edges 62 of platform 12 are configured to be generally tubular with the channel therein forming socket 60. In the embodiment of FIGS. 25 and 26, pin 58 is a generally elongated, cylindrically shaped outwardly extending member and socket 60 is configured to be a cooperatively sized (i.e., such that pin 58 has a diameter that is slightly smaller than that of socket 60) opening such that pin 58 is slidably received in socket 60 to reduce the amount of unwanted flexing between second end section 44 and center section 42. As will be readily apparent to those skilled in the art, the pin 58 and socket 60 configuration described above can be modified in a number of different ways to guide the separate sections of platform 12 together into abutting relationship. For instance, the locations of pin 58 and socket 60 can be reversed and pin 58 can be a generally rectangular, flat outwardly extending member that is received by a cooperatively configured (i.e., generally rectangular) shaped opening that receives pin 58 therein.

In the preferred embodiments of skateboard 13, pins 58 and sockets 60 described above are utilized merely to guide adjoining sections of platform 12 together. The cooperatively configured wheel mounting assemblies 14 and 16 are utilized to attach the respective wheel assemblies 26 to platform 12 and maintain the separate sections of platform 12 in their abutting relationship so as to form a unified platform 12. In the preferred embodiment, first 18 and second 20 mounting mechanisms each comprise an outwardly projecting wheel mount connector, such as first wheel mount connector 64 and second wheel mount connector 66, respectively, attached to bottom surface 38 of platform 12, as best shown in FIG. 23. As set forth below, wheel mount 28 of each of first 14 and second 16 wheel mounting assemblies is configured to engage first 64 and second 66 wheel mount connectors, respectively, to removably mount wheel assemblies 26 to platform 12. For a one-piece platform 12, first 64 and second 66 wheel mount connectors will generally be a single component. For the preferred embodiment of skateboard 13, with platform 12 in multiple sections such as shown in FIG. 24, first 64 and second 66 wheel mount connectors are provided in multiple components, such as 64*a*, 64*b*, 66*a* and 66*b*, as described above.

In the preferred configuration of skateboard 13, first 14 and second 16 wheel mounting assemblies cooperatively engage first 18 and second 20 mounting mechanisms, respectively, through the twist-and-lock type of connection described above. To provide this type of connection, each wheel mount 28 of first 14 and second 16 wheel mount assemblies has mounting cavity 68 with one or more receiving lips 70, best shown in FIG. 28, and each of first 64 and second 66 wheel mount connectors have one or more projecting lips 72. In the embodiment shown in FIG. 28, mounting cavity 68 has a pair of opposite disposed receiving lips 70 and each of first 64 and second 66 truck mount connectors have a pair of opposite disposed projecting lips 72. Mounting cavity 68 truck mount 28 is sized and configured to receive first 64 or second 66 truck mount connectors therein, depending on whether it is first 14 or second 16 truck mounting assembly. As previously indicated and as known to those familiar with twist-and-lock operation, mounting cavity 68 is configured to be placed over first 64 or second 66 truck mount connectors at a right angle to the normal, mounted direction and then first 14 or second 16 truck mounting assembly is twisted to place the assemblies in the correct direction such that projecting lips 72 of first 64 or second 66 truck mount connectors engage receiving lips 70 of mounting cavity 68 on truck mount 28 by receiving lips 70 slidably moving under projecting lips 72. Receiving lips 70 and projecting 72 should be configured such that receiving lips 70 of mounting cavity 68 are securely engaged by projecting lips of first 64 or second 66 truck mount connectors to tightly abut the sections of platform 12 together and secure first 14 and second 16 truck mounting assemblies on the bottom, mounting surface 38 of platform 12.

The twist-and-lock configuration described above can be configured to be generally sufficient to hold platform 12 in one piece and to mount first 14 and second 16 truck mounting assemblies on bottom surface 38 of platform 12. To better ensure that first 14 and second 16 truck mount assemblies stay in place on bottom surface 38 of platform 12, skateboard 13 can comprise a secondary locking or securing mechanism, such as that shown in FIGS. 22 through 24 as first securing mechanism 22 and second securing mechanism 24. Preferably, each of the first 22 and second 24 securing mechanisms comprise a securing assembly 74 attached to bottom surface 38 of platform 12 and an outwardly extending member 76 on first 14 and second 16 truck assemblies. As set forth below, outwardly extending member 76 should be configured to be sufficiently resilient to facilitate secure engagement with securing assembly 74. In one embodiment, outwardly extending member 76 is made out of a polycarbonate material or other plastic, composite or metal materials. In the embodiment shown in FIGS. 27 and 28, outwardly extending member 76 is generally configured as an L- or J-shaped member having an upper surface 78 and a lower surface 80 with a locking projection 82 thereon. This embodiment also utilizes a securing assembly 74 comprising securing base member 84 that is securely mounted to bottom surface 38 of platform 12, which has a locking cavity 86 near the end thereof, as best shown in FIG. 23. In the embodiment shown, locking projection 82 is a raised area of lower surface 80 of outwardly extending member 76 and locking cavity 86 is an aperture through base member 84. As explained in more detail below, locking projection 82 and locking cavity 86 should be cooperatively configured such that locking projection 82 will securely fit within locking cavity 86. In the preferred embodiment, the resilient nature of outwardly extending member 76 facilitates the engagement of locking projection 82 inside locking cavity 86 by allowing the user to push outwardly extending member 76 toward bottom surface 38 of platform 12 such that locking projection 82 can be rotated under base 84 until it is generally aligned with locking cavity 86, when the resilient nature of outwardly extending member 76 will push locking projection 82 into locking cavity 86.

Figure 29:
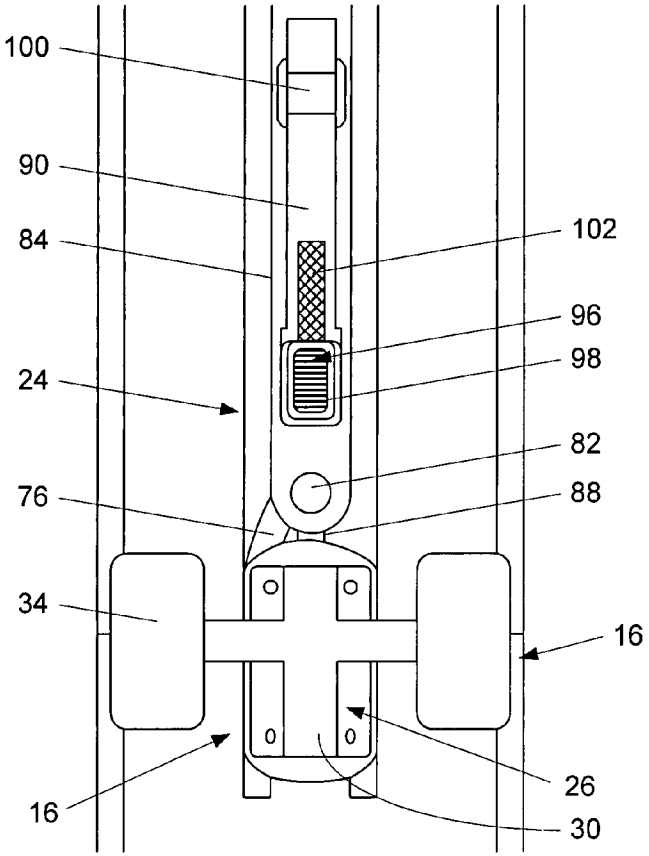
FIG. 29 is an isolated bottom plan view of the disassemblable skateboard of FIG. 22 showing the wheel mounting assembly attached to the platform and secured into place by the locking and securing assemblies, with the locking assembly shown in the locked condition and the securing assembly shown in the secured condition.

A preferred configuration of the skateboard 13 also has an additional securing mechanism as part of first 22 and second 24 securing mechanisms, shown in FIGS. 22 through 24 and 29 through 32, to further ensure that first 14 and second 16 truck mounting assemblies are secured to the bottom surface of platform 12. This additional securing mechanism also utilizes base member 84 to slidably dispose securing extension member 88, best shown in FIGS. 30 through 32, toward first 14 or second 16 truck mounting assemblies. Securing extension member 88 is configured to slide in extension channel 90 of base member 84 so that extension member 88 can engage locking aperture 92 on a side 94 of truck mount 28 (shown in FIG. 27) to better secure first 14 or second 16 truck mounting assemblies to bottom surface 38 of platform 12. As shown in FIG. 29, securing extension member 88 slides under outwardly extending member 76 to prevent locking projection 82 from being disengaged from locking cavity 86. In one embodiment, extension member 88 slidably engages the upper surface 78 of outwardly extending member 76 to help displace locking projection 82 into locking cavity 86. A securing latch 96 generally at the end of securing extension member 88 is utilized to lock securing extension member 88 inside locking aperture 92 when it is desired to secure first 14 or second 16 truck mounting assemblies to platform 12. In the configuration shown in FIGS. 29 through 32, securing latch 96 is configured with a thumb or finger push plate 98 to assist the user with moving securing latch 96, and therefore securing extension member 88, from the locked condition (shown in FIG. 29) to the unlocked condition (shown in FIGS. 30 through 32) to disengage securing extension member 88 from locking aperture 92 so that first 14 or second 16 truck mounting assembly can be removed from platform 12. An enlarged portion of channel 90 is configured to receive push plate 98 such that it moves outwardly and cannot move into the narrow portion of channel 90 unless force, typically the user's thumb or finger, is applied to push plate 98 in the enlarged portion of channel 90 to allow securing latch 96 to be moved away from first 14 or second 16 truck mounting assembly, thereby disengaging extension member 88 from locking aperture 92. In this manner, it is unlikely that securing latch 96 will be accidently moved and extension member 88 inadvertently disengaged from locking aperture 92. Stop member 100 is utilized to stop the movement of securing latch 96 and extension member 88 past the point necessary to disengage extension member 88 from locking aperture 92.

To assist the user in recognizing whether the first 14 and/or second 16 truck mounting assemblies are secured by extension member 88, the preferred securing mechanism utilizes a locked indicator 102 and an unlocked indicator 104. In a preferred embodiment, locked indicator 102 is located in channel 90 of base member 84 below the slidable extension member 88 and securing latch 96 and is not exposed unless push plate 98 of securing latch 96 is disposed in the enlarged portion of channel 90 and extension member 88 is engaged in locking aperture 92. When securing latch 96 is moved in channel 90 to disengage extension member 88 from locking aperture 92, locked indicator 102 will be covered up by extension member 88 and unlocked indicator 104, which is disposed on extension member 88, will become visible to warn the user that first 14 or second 16 truck mounting assembly is not secured by extension member 88. In one embodiment, locked indicator 102 is a patch or spot of green color and unlocked indicator 104 is a patch or spot of red color.

Figure 30:
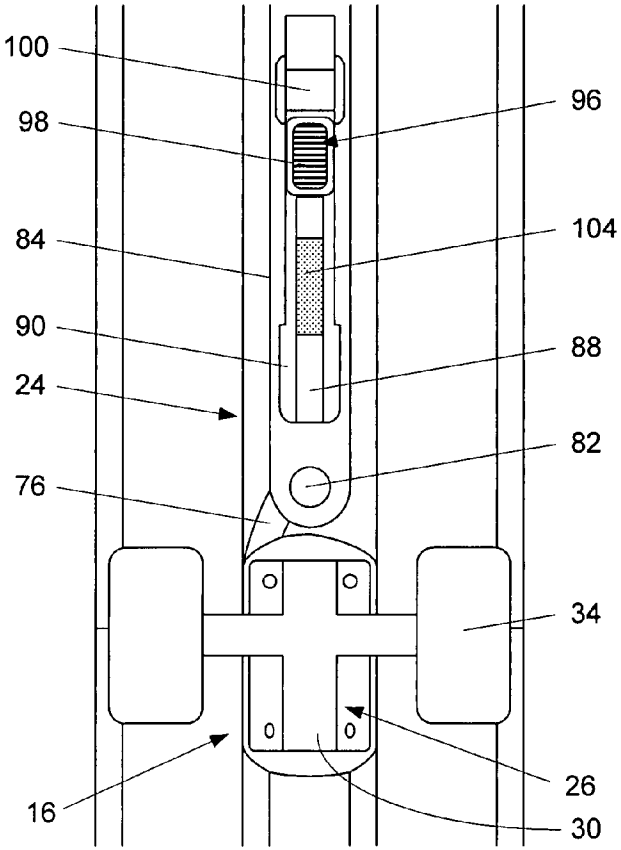
FIG. 30 is an isolated bottom plan view of the disassemblable skateboard of FIG. 29 with the locking assembly shown in the locked condition and the securing assembly shown in the unsecured condition.
Figure 32:
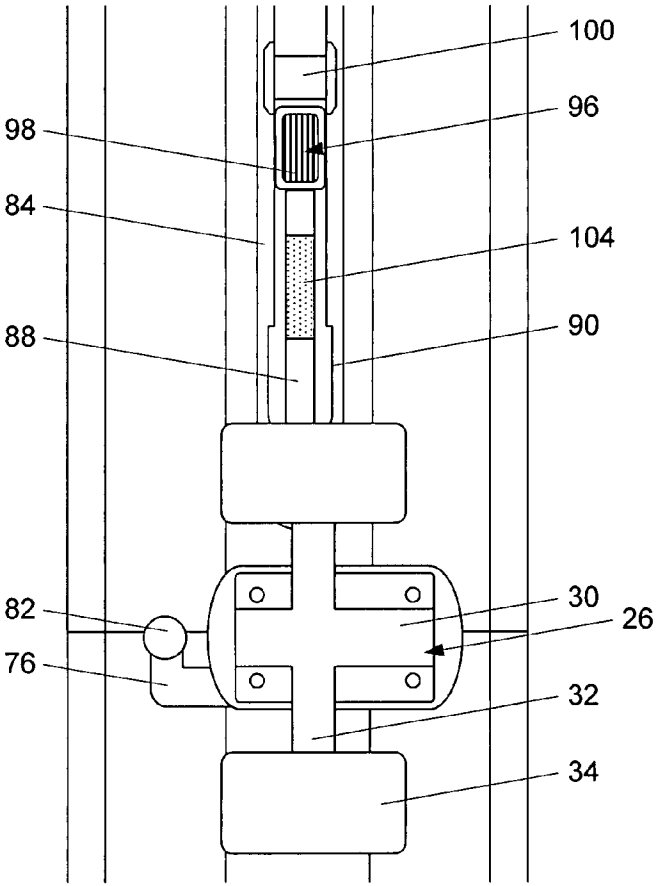
FIG. 32 is an isolated bottom plan view of the disassemblable skateboard of FIG. 31 shown with the wheel mount assembly in position for removal from the platform.
Figure 31:
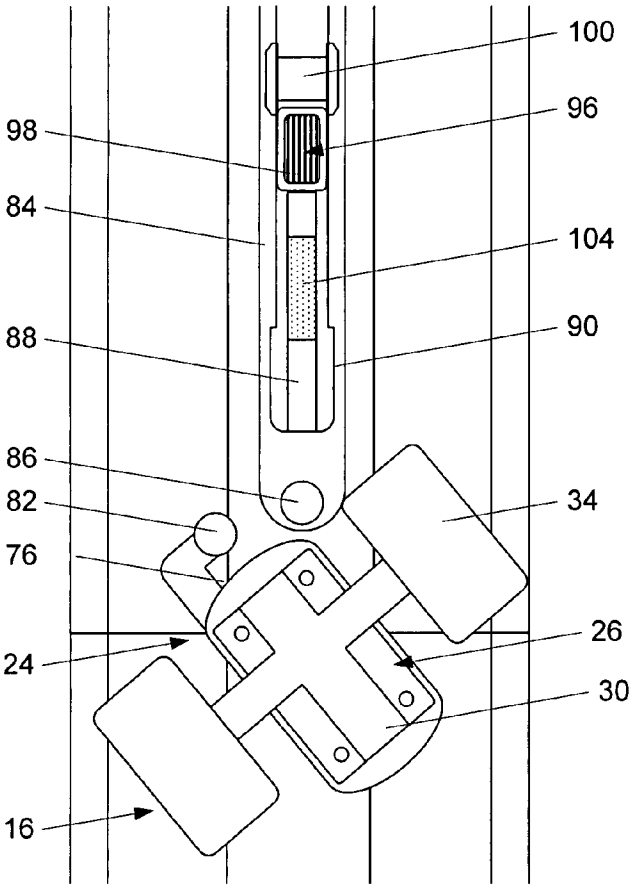
FIG. 31 is an isolated bottom plan view of the disassemblable skateboard of FIG. 30 with the wheel mount assembly shown unlocked and disengaged from the locking assembly.

The operation of skateboard 13 of the embodiment set forth above is shown in sequence, from locked condition to the unlocked ready to be removed condition, in FIGS. 29 through 32. In FIG. 29, second securing mechanism 24 is shown in the engaged or locked condition with truck mount 28 of second truck mounting assembly 16 mounted on second mounting mechanism 22 (not shown in FIG. 29) utilizing the twist-and-lock configuration described above, locking projection 82 of outwardly extending member 76 is engaged in locking cavity 86, securing latch 96 is at the enlarged portion of the channel 90 in base member 84, and extension member 88 is engaged inside locking aperture 92 of truck mount 28. Locked indicator 102 (i.e., a green colored area) is visible so as to indicate to the user that second securing mechanism 24 is in the secured or locked condition. As such, skateboard 13 is ready for riding or other use as, effectively, a single integral skateboard. In FIG. 30, securing latch 96 has been moved from the enlarged portion of channel 90, by pushing down on and sliding push plate 98, to a position at or near stop member 100 so as to withdraw or disengage extension member 88 from locking aperture 92. The locked indicator 102 (i.e., a red colored area) is covered by extension member 88 and the unlocked indicator 104 is displayed to indicate to the user that second securing mechanism 24 is not engaged. In FIG. 31, locking projection 82 on outwardly extending member 76 is disengaged from locking cavity 86, accomplished by pushing down on and twisting second truck mounting assembly 16, so as to begin the process of removing second truck mounting assembly 16 and truck assembly 26 from second mounting mechanism 22 (also not shown in FIG. 31). In this condition, receiving lips 70 of mounting cavity 68 on truck mounting assembly 16 are still partially engaged with projecting lips 72 on second truck mount connector 66, thereby preventing the complete removal of second truck mounting assembly 16 from platform 12. In FIG. 32, truck mount 28 of second truck mounting assembly 16 is completely twisted around on second truck mount connector 66 such that second truck mounting assembly 16 is ready to be removed from bottom surface 38 of platform 12. Once second wheel mounting assembly 16 is lifted off of and removed from second wheel mount connector 66, first end 54 of second end section 44 can be separated from second end 52 of center section 42. This same sequence is repeated for first wheel mounting assembly 14 to separate first end section 40 from center section 42, thereby making it easier for the user to store and carry skateboard 13.

Figure 33:
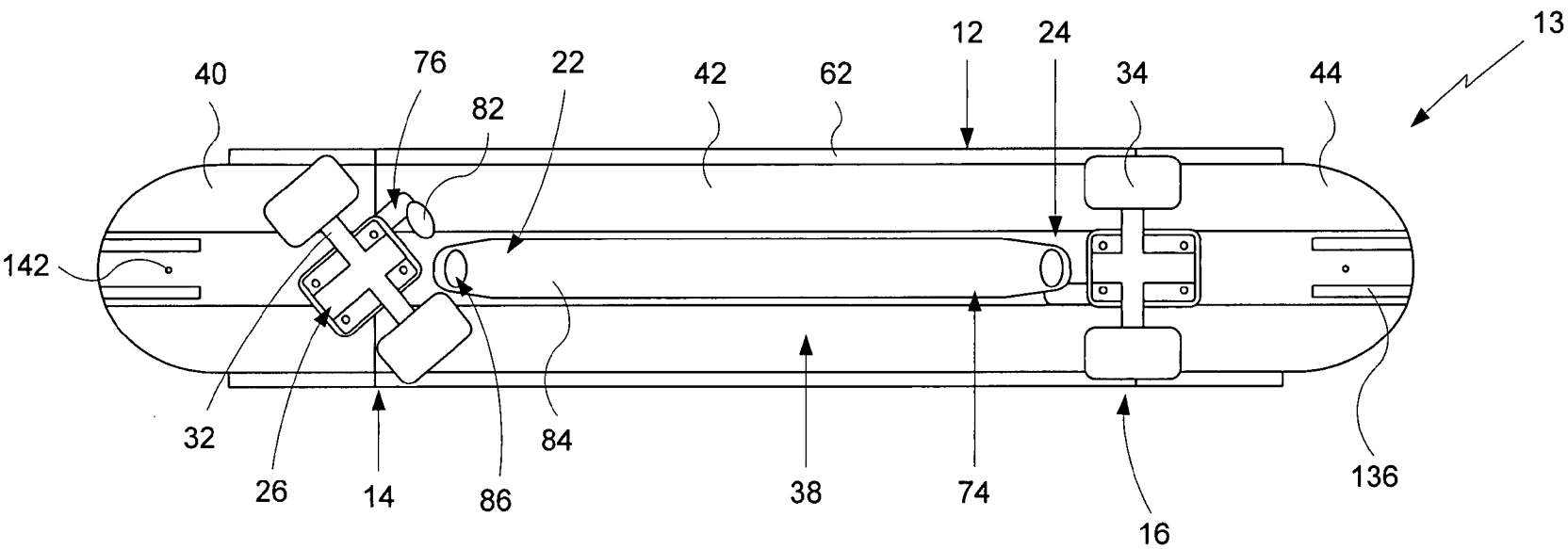
FIG. 33 is an alternative embodiment of the wheel mounting assembly of the present invention shown on a disassemblable skateboard with the forward/first wheel mounting assembly unlocked and disengaged from the locking mechanism and the rearward/second wheel mounting assembly secured in place by the locking mechanism.
Figure 34:
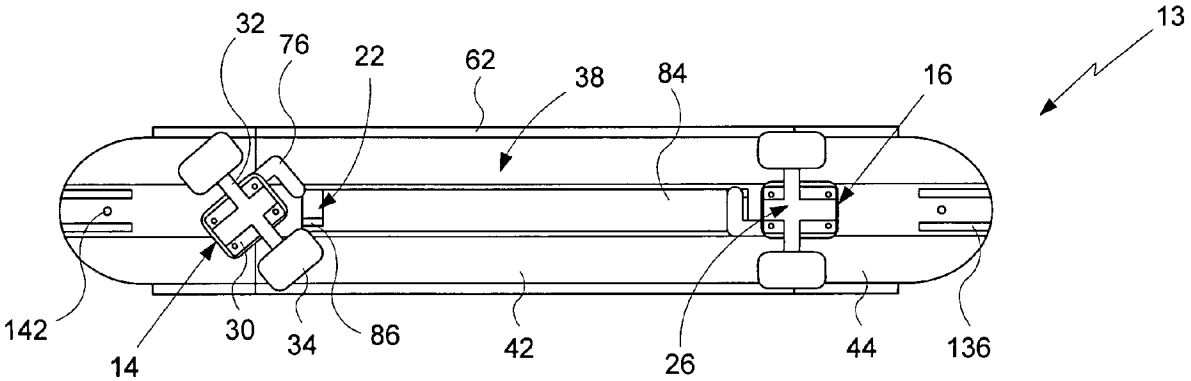
FIG. 34 is another alternative embodiment of the wheel mounting assembly of the present invention, also shown on a disassemblable skateboard, with the forward wheel mounting assembly secured in place by the locking mechanism and the rearward wheel mounting assembly unlocked and disengaged from the locking mechanism.
Figure 35:
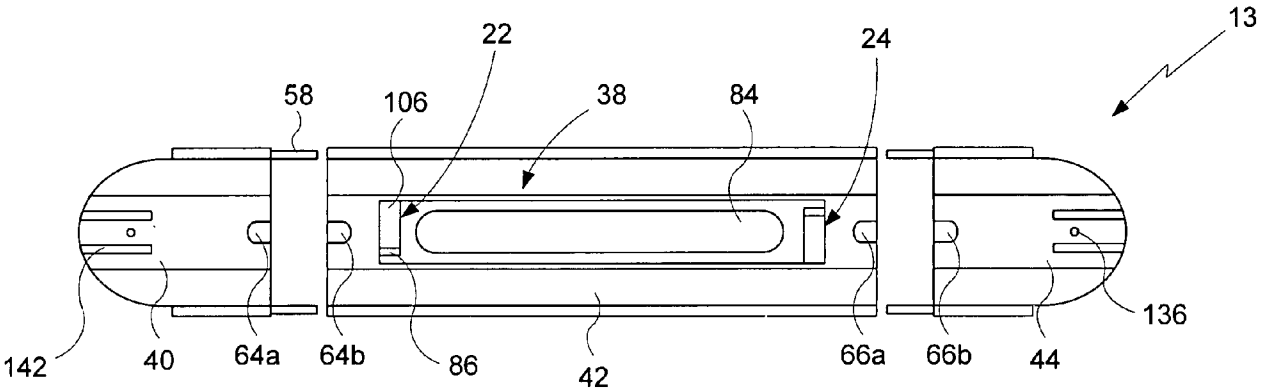
FIG. 35 is an exploded view of the platform utilized with the embodiment of the wheel mounting assembly shown in FIG. 34.

An alternative embodiment of the present invention is shown in FIG. 33. In this embodiment, most of the same features described above are also utilized. For instance, the same twist-and-lock arrangement are utilized for first 14 and second 16 wheel mounting assemblies to mount to the first 18 and second 20 mounting mechanisms (not shown in FIG. 33) described above. Outwardly extending member 76 is basically configured the same except it has a generally oval shaped locking projection 82 that is shaped and configured to fit within like configured locking cavity 86, as shown for second wheel mounting assembly 16. In this embodiment, securing assembly 74 comprises securing base member 84 with a locking cavity 86 at each end. The additional securing mechanism of the slidable extension member 88, used to more securely engage locking projection 82 in locking aperture 86, is not utilized in this embodiment. Likewise the locked 102 and unlocked indicators are also not utilized. As described above for the previous embodiment, platform 12 can be a single piece or it can comprise two or more platform sections, such as the three platform sections shown, for easier carrying and storage.

Figures 36, 37:
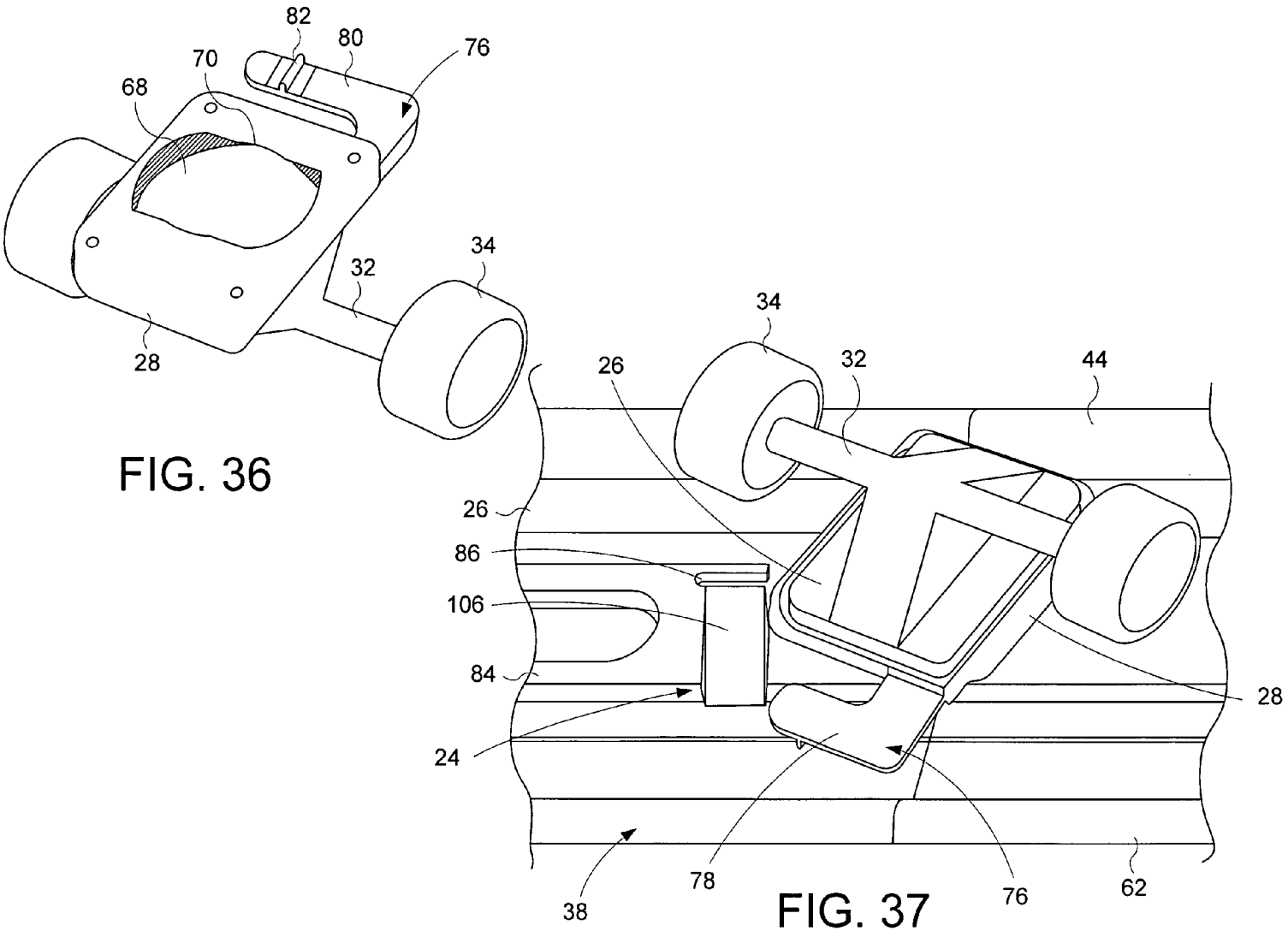
FIG. 36 is a top perspective view of the wheel mounting assembly of FIG. 34.
FIG. 37 is a bottom perspective view of a portion of the disassemblable skateboard of FIG. 34 showing the wheel mounting assembly mounted on the platform but disengaged from the locking mechanism.

Another alternative embodiment is shown in FIGS. 34 through 37. In this embodiment, first 14 and second 16 wheel mounting assemblies mount to the first 18 and second 20 mounting mechanisms (the first 64 and second 66 mount connectors, which are not specifically shown), respectively, using the same twist-and-lock arrangement described in the above embodiments to mount to bottom surface 38 of platform 12 and to join first end section 40 to center section 42 and second end section 44 to center section 42. This embodiment also utilizes the outwardly extending member 76 attached to wheel mount 28 having mounting cavity 68 configured to receive first 64 or second 66 mount connectors (shown in FIG. 35 as components 64*a*, 64*b*, 66*a* and 66*b*) therein for engagement of receiving lips 70 and projecting lips 72 to accomplish the "lock" part of the twist-and-lock arrangement. The difference with this embodiment is the configuration of first 22 and second 24 securing mechanisms, the placement of locking projection 82 and the manner in which locking projection 82 engages locking cavity 86. As best shown in FIGS. 36 and 37, in this embodiment locking projection 82 is located on the lower surface 80 of outwardly extending member 76 (instead of the upper surface 78, which can be generally planar in this embodiment) and first 22 and second 24 securing mechanisms have a ramp section 106 configured to direct outwardly extending member 76 toward locking cavity 86 for engagement with locking projection 82 therein. Ramp section 106 is an inclined section of securing base member 84 that takes advantage of the flexible or resilient nature of outwardly extending member 76 to obtain the engagement between wheel mount 28 and first 22 or second 24 securing mechanisms. In use, as the user twists the first 14 or second 16 mounting assembly on first 64 or second 66 wheel mount connector the locking projection 82 on outwardly extending member 76 will make contact with ramp section 106 of base member 84. As the first 14 or second 16 mounting assembly is twisted toward its engagement with first 18 or second 20 mounting mechanisms, the contact between locking projection 82 and ramp section 106 flexes or lifts outwardly extending member 76 until locking projection 82 drops into locking cavity 86, thereby preventing further rotation of first 14 or second 16 mounting assembly without first disengaging locking projection 82 from locking cavity 86. The flexible or resilient nature of outwardly extending member 76 will provide force to maintain engagement of locking projection 82 in locking cavity 86. At the same time, receiving lips 70 of mounting cavity 68 are engaged with projecting lips 72 of first 64 or second 66 wheel connectors, thereby mounting first 14 or second 16 mounting assemblies on platform 12 and joining platform sections 40, 42 and 44 together to form a unified platform 12. The engagement of locking projection 82 in locking cavity 86 prevents further twisting (i.e., dismounting) of first 14 or second 16 mounting assemblies. For typical riding on skateboard 13, the above described engagement of locking projection 82 in locking cavity 86, as well as the twist-and-lock connection of first 14 or second 16 mounting assemblies, should be sufficient to maintain skateboard 13 in its assembled condition. If skateboard 13 is to be used for jumps, spins or other tricks it may be beneficial to include the additional securing mechanism described above with regard to the use of extension member 88 and its engagement with locking aperture 92 on wheel mount 28.

For each of the above-described embodiments, it is preferred that skateboard 13 be made out of materials that are lightweight to reduce the burden on the user when carrying skateboard 13 in a backpack or other carrying case and sufficiently durable, strong and corrosion resistant for use as a skateboard 13. In a preferred embodiment, most of the components are made out of a lightweight, strong metal, such as aluminum and the like, with outwardly extending member 76 made out of sufficiently resilient plastic, such as the polycarbonate material described above. Wheel assembly 26 can be configured and made out of materials commonly utilized for presently available skateboards, including the various materials which are known to be desirable for wheels 34.

While there are shown and described herein certain specific alternative forms of the invention, it will be readily apparent to those skilled in the art that the invention is not so limited, but is susceptible to various modifications and rearrangements in design and materials without departing from the spirit and scope of the present invention. In particular, it should be noted that the present invention is subject to modification with regard to assembly, materials, size, shape and use. For instance, some of the components described above can be made integral with each other to reduce the number of separate components and various replacement components can be utilized that perform the same function as those described above.

What is claimed is:

1. A wheel mount assembly for removably attaching a wheel assembly to a wheeled object, said wheel mount assembly comprising:

an outwardly projecting wheel mount connector on said wheeled object;

a wheel mount having a mounting cavity shaped and configured to receive said wheel mount connector therein, said wheel mount configured to cooperatively engage said wheel mount connector so as to releasably attach said wheel mount to said wheeled object, said wheel mount connector and said wheel mount configured for twist-and-lock engagement, said wheel assembly attached to or integral with said wheel mount; and securing means interconnecting said wheel mount connector and said wheel mount for removably securing said wheel mount to said wheel mount connector, said securing means comprising an elongated spring member, a guide member and an engagement member on said wheel mount and a cut-out section in said wheel mount connector, a first end of said spring member attached to said wheel mount, a second end of said spring member attached to or integral with said guide member, said engagement member sized and configured to be received in said cut-out section, said spring member configured to bias said engagement member into said cut-out section.

2. The wheel mount assembly according to claim 1, wherein said guide member is configured to selectively move said engagement member out of said cut-out section to allow removal of said wheel mount from said wheel mount connector.

3. The wheel mount assembly according to claim 2, wherein said wheel mount comprises a pair of guide member supports defining a guide cavity, said guide member slidably disposed in said guide cavity between said guide member supports.

4. The wheel mount assembly according to claim 3 further comprising a wheel mount securing means for securing said guide member in said guide cavity so as to prevent said engagement member from moving out of said cut-out section.

5. The wheel mount assembly according to claim 4, wherein said wheel mount securing means comprises a ball disposed in at least one of said guide member supports and a detent cooperatively positioned on a side of said guide member, said ball biased into said guide cavity from said at least one of said guide member supports and received in said detent so as to secure said guide member in said guide cavity and said engagement member in said cut-out section.

6. The wheel mount assembly according to claim 4, wherein each of said guide member supports has a ball biased into said guide cavity from said guide member supports and said guide member has a detent cooperatively positioned on each of two sides thereof, each of said balls being biased into and received in said detents so as to secure said guide member in said guide cavity and said engagement member in said cut-out section.

7. The wheel mount assembly according to claim 4, wherein said wheel mount securing means comprises a button slidably disposed in a button aperture in said guide member and a biasing means for biasing said button out of said button aperture.

8. The wheel mount assembly according to claim 7, wherein said wheel mount securing means further comprises a slide rod connected to said button and a detent configured to receive said slide rod when said biasing means biases said button.

9. The wheel mount assembly according to claim 4, wherein said wheel mount securing means comprises a slide mechanism on said wheeled object and a channel in said engagement member, said slide mechanism having a retainer bar configured to be slideably received in said channel so as to selectively secure said engagement member in said cut-out section.

10. The wheel mount assembly according to claim 9, wherein said wheel mount securing means further comprises a bar lock member on said guide member and a detent on said retainer bar, said bar lock member sized and configured to engage said detent so as to prevent said retainer bar from sliding out of said channel

11. The wheel mounting assembly according to claim 1, wherein said wheeled object comprises a platform having a top surface and a bottom surface.

12. The wheel mount assembly according to claim 11, wherein said platform comprises two or more platform sections and said wheel mount connector comprises two or more connector components, at least one of said connector components on each of said platform sections, said mounting cavity of said wheel mount configured to hold said connector components together so as to abuttingly join said platform sections together.

13. The wheel mount assembly according to claim 12, wherein said platform sections comprises a first end section, a second end section and a center section disposed between said first end section and said second end section.

14. The wheel mount assembly according to claim 13, wherein said wheeled object comprises a first wheel mount connector on said platform configured to removably mount a first wheel mount to said bottom surface of said platform so as to abuttingly join a second end of said first end section to a first end of said center section and a second wheel mount on said platform configured to removably mount a second wheel mount to said bottom surface of said platform so as to abuttingly join a first end of said second end section to a second end of said center section.

15. The wheel mounting assembly according to claim 11, wherein said wheel mount connector is on said bottom surface of said platform.

16. The wheel mount assembly according to claim 1, wherein said securing means comprises at least one projecting lip on said wheel mount connector and at least one receiving lip on said mounting cavity, said projecting lip configured to engage said receiving lip to attach said wheel mount to said wheeled object.

17. A wheel mount assembly for removably attaching a wheel assembly to a mount surface of a platform, said wheel mount assembly comprising:

an outwardly projecting wheel mount connector on said mounting surface of said platform, said wheel mount connector having at least one projecting lip thereon;

a wheel mount having a pair of guide member supports and a mounting cavity, said guide members defining a guide cavity, said mounting cavity having at least one receiving lip thereon, said mounting cavity shaped and configured to receive said wheel mount connector therein, said receiving lip configured to cooperatively engage said projecting lip on said wheel mount connector so as to releasably attach said wheel mount to said platform, said wheel mount connector and said wheel mount configured for twist-and-lock engagement, said wheel assembly attached to or integral with said wheel mount;

securing means interconnecting said wheel mount connector and said wheel mount for removably securing said wheel mount to said wheel mount connector, said securing means comprising an elongated spring member, a guide member and an engagement member on said wheel mount and a cut-out section in said wheel mount connector, said spring member attached to said wheel mount and attached to or integral with said guide member, said engagement member sized and configured to be received in said cut-out section, said spring member configured to bias said engagement member into said cut-out section, said guide member slidably disposed in said guide cavity between said guide member supports and configured to selectively move said engagement member out of said cut-out section to allow removal of said wheel mount from said wheel mount connector; and a wheel mount securing means for securing said guide member in said guide cavity so as to prevent said engagement member from moving out of said cut-out section.

18. The wheel mount assembly according to claim 17, wherein said wheel mount securing means comprises a slide mechanism on said mounting surface and a channel in said engagement member, said slide mechanism having a retainer bar configured to be slideably received in said channel so as to selectively secure said engagement member in said cut-out section.

19. The wheel mount assembly according to claim 18, wherein said wheel mount securing means further comprises a bar lock member on said guide member and a detent on said retainer bar, said bar lock member sized and configured to engage said detent so as to prevent said retainer bar from sliding out of said channel

20. The wheel mount assembly according to claim 17, wherein said wheel mount securing means comprises a button slidably disposed in a button aperture in said guide member and a biasing means for biasing said button out of said button aperture.

21. The wheel mount assembly according to claim 20, wherein said wheel mount securing means further comprises a slide rod connected to said button and a detent configured to receive said slide rod when said biasing means biases said button.

22. The wheel mount assembly according to claim 17, wherein said wheel mount securing means comprises a ball disposed in at least one of said guide member supports and a detent cooperatively positioned on a side of said guide member, said ball biased into said guide cavity from said at least one of said guide member supports and received in said detent so as to secure said guide member in said guide cavity and said engagement member in said cut-out section.

23. The wheel mount assembly according to claim 17, wherein each of said guide member supports has a ball biased into said guide cavity from said guide member supports and said guide member has a detent cooperatively positioned on each of two sides thereof, each of said balls being biased into and received in said detents so as to secure said guide member in said guide cavity and said engagement member in said cut-out section.

24. A wheel mount assembly for removably attaching a wheel assembly to a mount surface of a platform, said wheel mount assembly comprising:

an outwardly projecting wheel mount connector on said mounting surface of said platform;

a wheel mount having a mounting cavity, said mounting cavity shaped and configured to receive said wheel mount connector therein and to cooperatively engage said wheel mount connector so as to releasably attach said wheel mount to said platform, said wheel mount connector and said wheel mount configured for twist-and-lock engagement, said wheel assembly attached to or integral with said wheel mount;

latching means interconnecting said wheel mount connector and said wheel mount for removably latching said wheel mount to said wheel mount connector, said latching means having an elongated spring member, a guide member and an engagement member on said wheel mount and a cut-out section in said wheel mount connector, a first end of said spring member attached to said wheel mount and a second end of said spring member attached to or integral with said engagement member, said engagement member attached to or integral with said guide member and sized and configured to be received in said cut-out section, said spring member configured to bias said engagement member into said cut-out section, said guide member configured to selectively move said engagement member out of said cut-out section to allow removal of said wheel mount from said wheel mount connector; and securing means for securing said guide member in said guide cavity so as to prevent said engagement member from moving out of said cut-out section, said securing means having a button slidably disposed in a button aperture in said guide member and a means for biasing said button out of said button aperture.

25. The wheel mount assembly according to claim 24, wherein said wheel mount comprises a mount body and a mount base, said elongated spring member flexibly disposed between said mount body and said mount base.

26. The wheel mount assembly according to claim 25, wherein said first end of said spring member is disposed at a first end of said mount body and said second end of said spring member is disposed a second end of said mount body, said guide member and said engagement member disposed generally at or towards said second end of said second end of said mount body.

27. The wheel mount assembly according to claim 24, wherein said securing means further comprises a slide rod connected to said button and a detent configured to receive said slide rod when said biasing means biases said button.

28. The wheel mount assembly according to claim 24, wherein said wheel mount connector has at least one projecting lip thereon and said mounting cavity has at least one receiving lip thereon, said projecting lip configured to engage said receiving lip to attach said wheel mount to said wheel mount connector.

29. A wheel mount assembly for removably attaching a wheel assembly to a wheeled object, said wheel mount assembly comprising:

an outwardly projecting wheel mount connector on said wheeled object;

a wheel mount having a pair of guide member supports and a mounting cavity, said guide member supports defining a guide cavity, said mounting cavity shaped and configured to receive said wheel mount connector therein, said wheel mount configured to cooperatively engage said wheel mount connector so as to releasably attach said wheel mount to said wheeled object, said wheel mount connector and said wheel mount configured for twist-and-lock engagement, said wheel assembly attached to or integral with said wheel mount;

securing means interconnecting said wheel mount connector and said wheel mount for removably securing said wheel mount to said wheel mount connector, said securing means having an elongated spring member, a guide member and an engagement member on said wheel mount and a cut-out section in said wheel mount connector, said spring member attached to said wheel mount and attached to or integral with said guide member, said engagement member sized and configured to be received in said cut-out section, said spring member configured to bias said engagement member into said cut-out section, said guide member configured to selectively move said engagement member out of said cut-out section to allow removal of said wheel mount from said wheel mount connector, said guide member slidably disposed in said guide cavity between said guide member supports; and a wheel mount securing means for securing said guide member in said guide cavity so as to prevent said engagement member from moving out of said cut-out section.

30. The wheel mount assembly according to claim 29, wherein said wheel mount securing means comprises a button slidably disposed in a button aperture in said guide member and a biasing means for biasing said button out of said button aperture.

31. The wheel mount assembly according to claim 30, wherein said securing means further comprises a slide rod connected to said button and a detent configured to receive said slide rod when said biasing means biases said button.

32. The wheel mount assembly according to claim 29, wherein said wheel mount securing means comprises a ball disposed in at least one of said guide member supports and a detent cooperatively positioned on a side of said guide member, said ball biased into said guide cavity from said at least one of said guide member supports and received in said detent so as to secure said guide member in said guide cavity and said engagement member in said cut-out section.

33. The wheel mount assembly according to claim 29, wherein each of said guide member supports has a ball biased into said guide cavity from said guide member supports and said guide member has a detent cooperatively positioned on each of two sides thereof, each of said balls being biased into and received in said detents so as to secure said guide member in said guide cavity and said engagement member in said cut-out section.

34. The wheel mount assembly according to claim 29, wherein said wheel mount securing means comprises a slide mechanism on said wheeled object and a channel in said engagement member, said slide mechanism having a retainer bar configured to be slidably received in said channel so as to selectively secure said engagement member in said cut-out section.

35. The wheel mount assembly according to claim 34, wherein said wheel mount securing means further comprises a bar lock member on said guide member and a detent on said retainer bar, said bar lock member sized and configured to engage said detent so as to prevent said retainer bar from sliding out of said channel.

* * * * *